US006619614B2

(12) United States Patent
Parsons et al.

(10) Patent No.: US 6,619,614 B2
(45) Date of Patent: Sep. 16, 2003

(54) AUTOMATIC FLOW CONTROLLER EMPLOYING ENERGY-CONSERVATION MODE

(75) Inventors: Natan E. Parsons, Brookline, MA (US); Xiaoxiong Mo, Nashua, NH (US)

(73) Assignee: Arichell Technologies, Inc., W. Newton, MA (US)

( * ) Notice: Subject to any disclaimer, the term of this patent is extended or adjusted under 35 U.S.C. 154(b) by 67 days.

(21) Appl. No.: 10/012,226

(22) Filed: Dec. 4, 2001

(65) Prior Publication Data

US 2003/0102449 A1 Jun. 5, 2003

(51) Int. Cl.[7] ..... F16K 31/02
(52) U.S. Cl. ..... 251/129.04; 4/302
(58) Field of Search ..... 251/129.04; 4/302, 4/304, 305

(56) References Cited

U.S. PATENT DOCUMENTS 4,570,272 A * 2/1986 Kawaguchi et al. ..... 4/302
5,036,553 A * 8/1991 Sanderson ..... 4/313
5,315,719 A * 5/1994 Tsutsui et al. ..... 4/300
5,508,510 A * 4/1996 Laverty et al. ..... 4/304
5,819,336 A * 10/1998 Gilliam et al. ..... 4/304
6,024,059 A * 2/2000 Kamimaru et al. .... 251/129.01
6,273,394 B1 * 8/2001 Vincent et al. ..... 251/129.04
6,293,516 B1 * 9/2001 Parsons et al. ..... 251/129.04
6,340,032 B1 * 1/2002 Zosimadis ..... 137/552
6,353,942 B1 * 3/2002 Pondelick et al. ..... 4/431
6,367,096 B1 * 4/2002 Quintana ..... 4/427

* cited by examiner

*Primary Examiner*—Gene Mancene
*Assistant Examiner*—John Bastianelli
(74) *Attorney, Agent, or Firm*—Cesari and McKenna, LLP

(57) ABSTRACT

An automatic flusher includes an object sensor. When the object sensor detects a target meeting certain criteria, battery-powered control circuitry causes the flusher's valve to open. By pressing a push button, a user can make the circuit open the flusher's valve. If the circuit has been pressed continually for an extended period, the control circuit assumes a sleep mode, in which its power consumption is negligible. A button actuator in the flusher's container keeps the button pressed while the container is closed. As a consequence, the flusher can be packed with the control circuit's batteries installed without draining those batteries significantly during shipping and storage.

44 Claims, 18 Drawing Sheets

AUTOMATIC FLOW CONTROLLER EMPLOYING ENERGY-CONSERVATION MODE

BACKGROUND OF THE INVENTION

1. Field of the Invention

The present invention concerns automatic flow controllers and in particular their energy-conservation features.

2. Background Information

Automatic flow-control systems have become increasingly prevalent, particularly in public rest-room facilities. Automatic faucets and flushers contribute to hygiene, facility cleanliness, and water conservation. In such systems, object sensors detect the user and operate a flow-control valve in response to user detection. In the case of an automatic faucet, for instance, presence or motion of a user's hands in the faucet's vicinity normally results in flow from the faucet. In the case of an automatic flusher, detection of the fact that a user has approached the facility and then left is typically what triggers flushing action.

Although the concept of such object-sensor-based automatic flow control is not new, its use was quite limited until recently. One reason for its popularity increase in recent years is the recent availability of battery-powered conversion kits. These kits make it possible for manual facilities to be converted into automatic facilities through simple part replacements that do not require employing electricians to wire the system to the supply grid. Because of extensive design effort directed to simplifying installation, the installer usually needs only to remove some easily removed parts, install batteries in the conversion kit, and mount the kit in place of the removed parts. The resultant system's power consumption can be made so modest that it is not unusual for the resultant automatic flow controller to operate more than three years between battery replacement, even though it is typically employed in a high-usage area such as a public rest room.

SUMMARY OF THE INVENTION

We have devised a way of simplifying installation even further without, in many cases, adding any additional hardware. We include in the kit a switch to which the kit's control circuit responds by going into a low-power mode if the switch has remained in its operated state for an extended period of time, such as, say, thirty seconds. In the low-power mode, the control circuit refrains from performing certain high-power functions, such as transmitting sensor radiation or operating a valve. The time delay enables a switch normally to be used for some other purpose, so the switch can be one that would have been provided in any case. If the switch is push-button operated, for instance, its normal use can be to provide a manual-flush capability, since a user will not keep the push button pressed for the extended period needed to place the control circuit into its low-power mode. But packaging used for shipment and storage can be so designed as to keep the push button pressed—and the control circuit in its low-power mode-until the kit is unpacked. Alternatively, the switch can be a reed switch, and a magnet included in the packaging could keep the switch operated.

BRIEF DESCRIPTION OF THE DRAWINGS

The invention description below refers to the accompanying drawings, of which.

DETAILED DESCRIPTION OF AN ILLUSTRATIVE EMBODIMENT

Although the present invention can be implemented in automatic flow-control systems of other types, such as automatic faucets, the drawings will illustrate it by reference to a direct-flush system, i.e., a flush system in which the supply pressure itself, as opposed to the gravity or otherwise-imposed pressure in a tank, is employed to flush the bowl.

Figure 1:
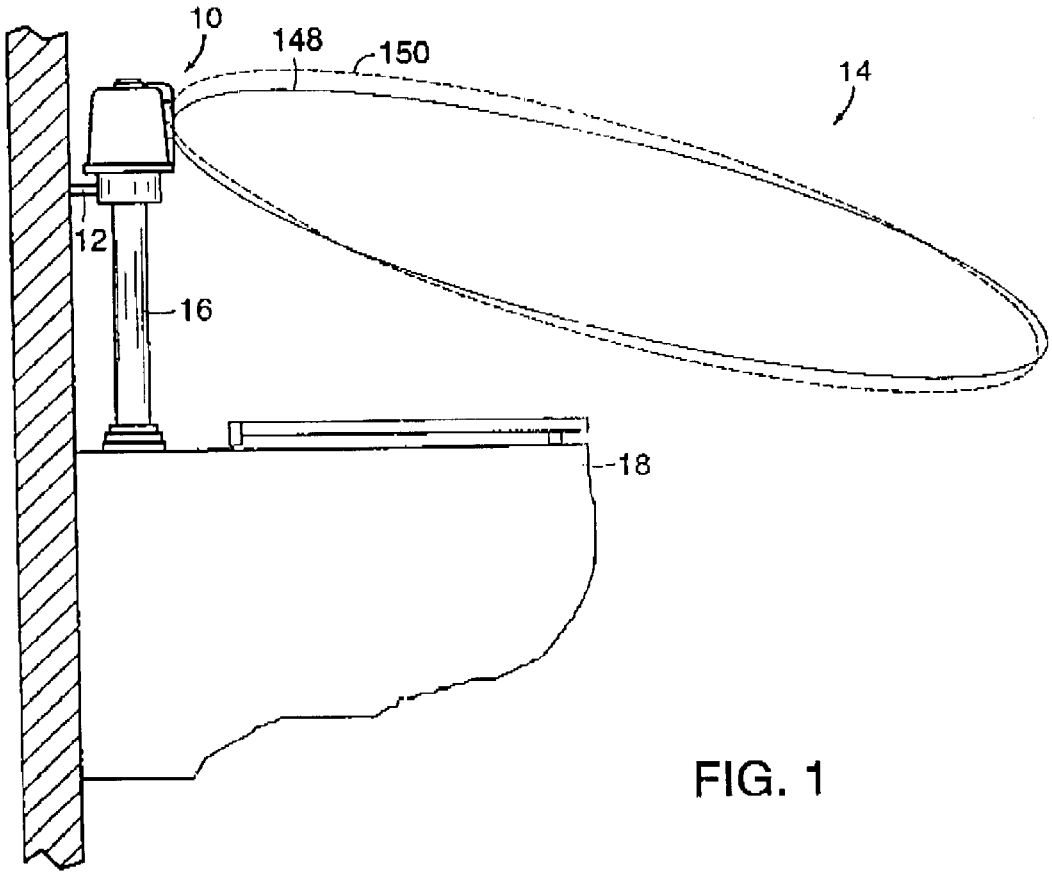
FIG. 1 is a side elevation of a toilet and an accompanying automatic flusher that employs the present invention's teachings.
Figure 2:
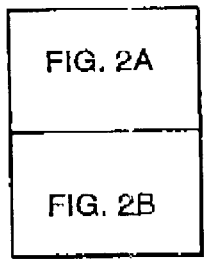
FIGS. 2A and 2B together form a cross-sectional view of the flusher illustrating the location of the flusher's control circuitry, manual-flush button, and flow path.
Figure 2A:
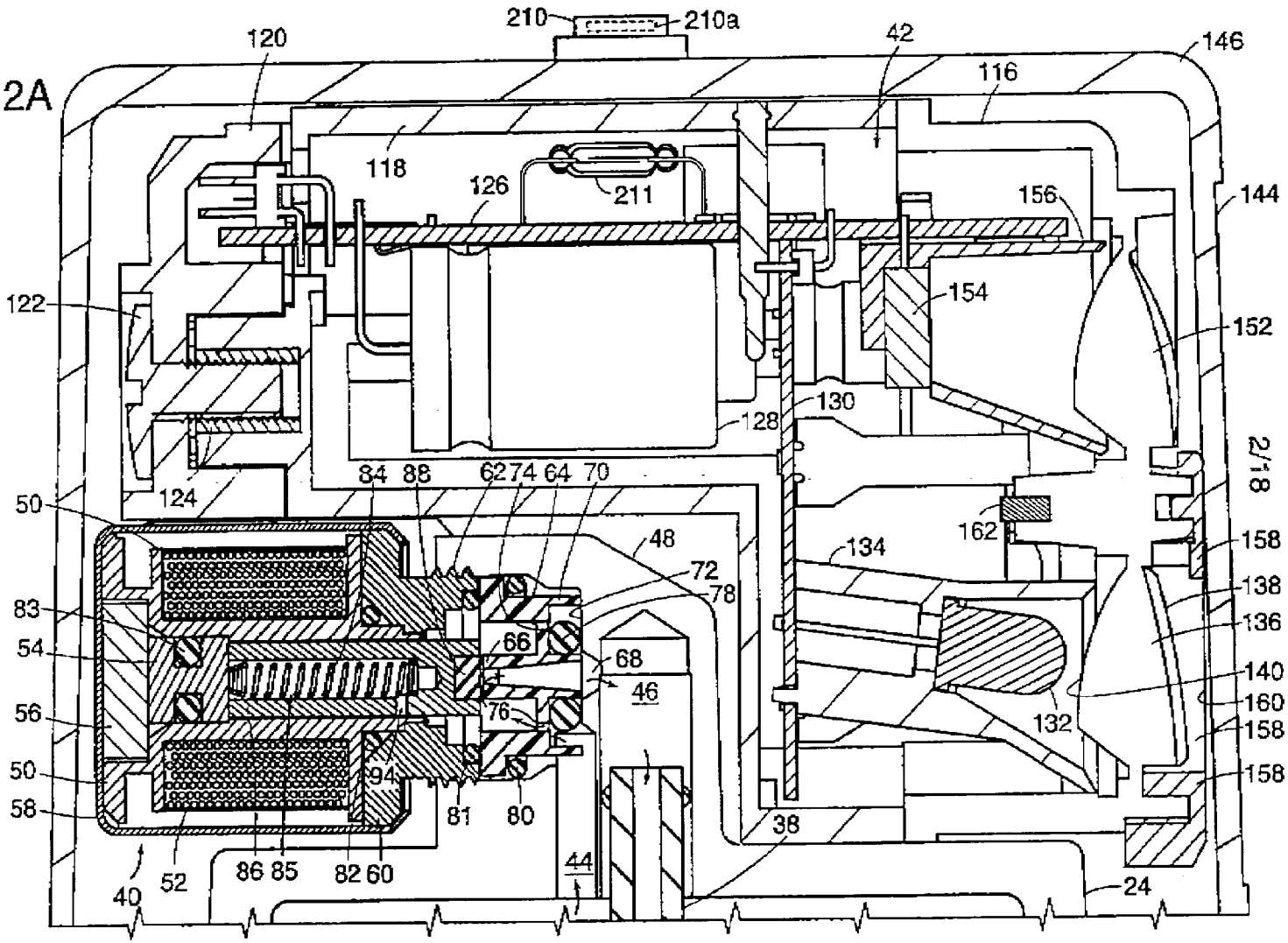
Figure 2B:
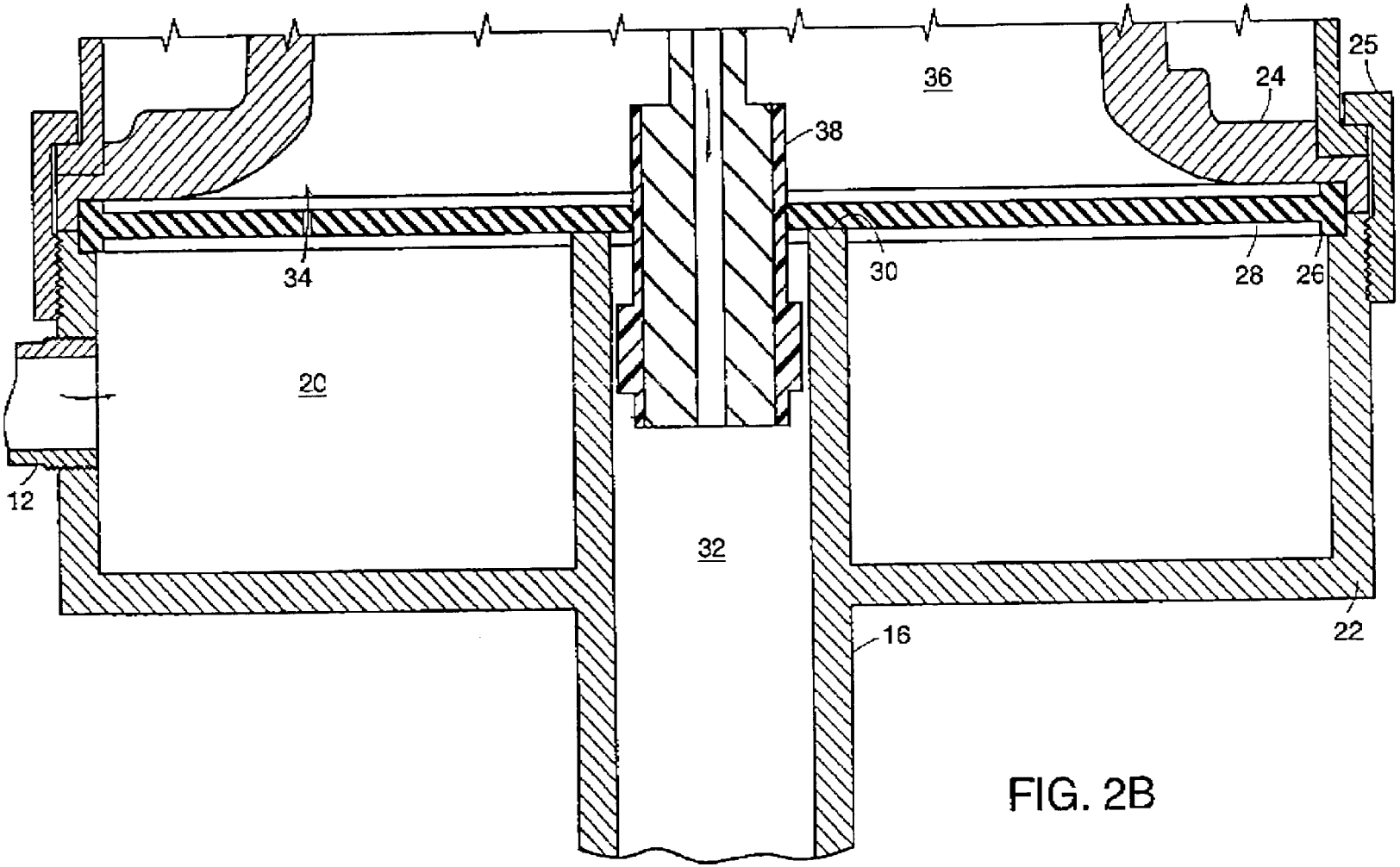

In FIG. 1, a flusher 10 receives pressurized water from a supply line 12 and employs an object sensor, typically of the infrared variety, to respond to actions of a target within a target region 14 by selectively opening a valve that permits water from the supply line 12 to flow through a flush conduit 16 to the bowl of a toilet 18. FIGS. 2A and 2B show that the supply line 12 communicates with an annular entrance chamber 20 defined by an entrance-chamber wall 22 formed near the flush conduit 16's upper end. A pressure cap 24 secured by a retaining ring 25 to the chamber housing clamps between itself and that housing the outer edge 26 of a flexible diaphragm 28 seated on a main valve seat 30 formed by the flush conduit 16's mouth.

The supply pressure that prevails in the entrance chamber 20 tends to unseat the flexible diaphram 28 and thereby cause it to allow water from the supply line 12 to flow through the entrance chamber 20 into the flush conduit 16's interior 32. But the diaphragm 28 ordinarily remains seated because of pressure equalization that a bleed hole 34 formed by the diaphragm 28 tends to permit between the entrance chamber 20 and a main pressure chamber 36 formed by the pressure cap 24. Specifically, the pressure that thereby prevails in that upper chamber 36 exerts greater force on the diaphragm 28 than the same pressure within entrance chamber 20 does, because the entrance chamber 20's pressure prevails only outside the flush conduit 16, whereas the pressure in the main pressure chamber 36 prevails everywhere outside of a through-diaphragm feed tube 38. To flush the toilet 18, a solenoid-operated actuator assembly 40 controlled by circuitry 42 relieves the pressure in the main pressure chamber 38 by permitting fluid flow, in a manner to be described in more detail below, between pilot entrance and exit passages 44 and 46 formed by the pressure cap 24's pilot-housing portion 48.

Figure 3:
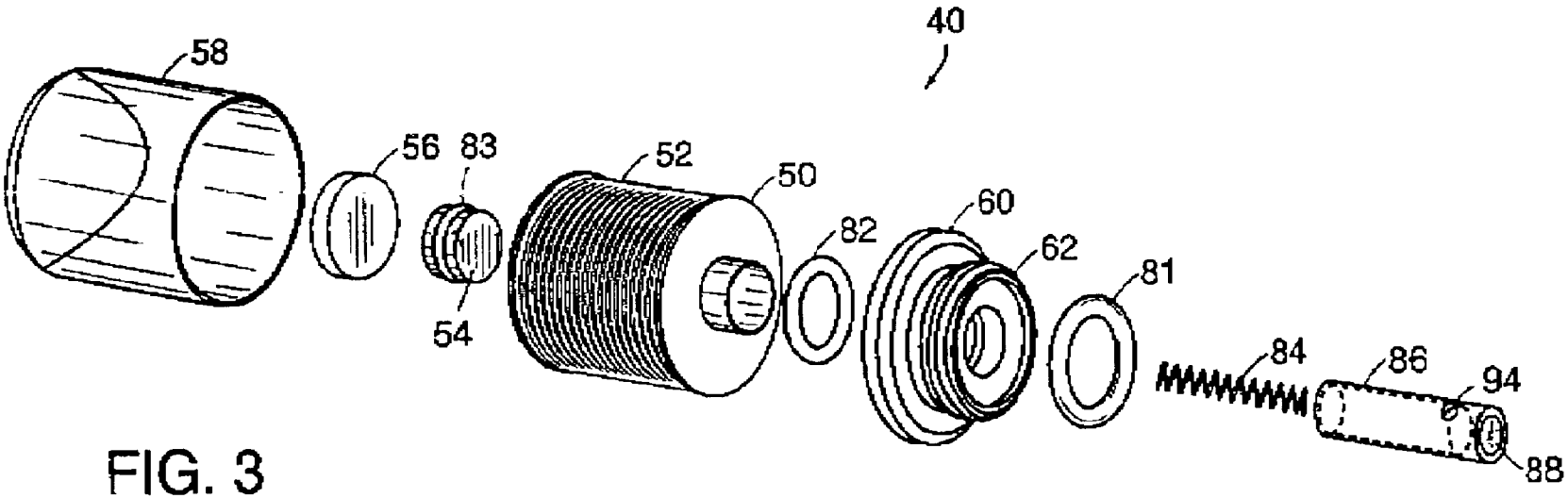
FIG. 3 is an exploded view of a latching version of the pilot-valve operator shown in FIG. 2A.
Figure 4:
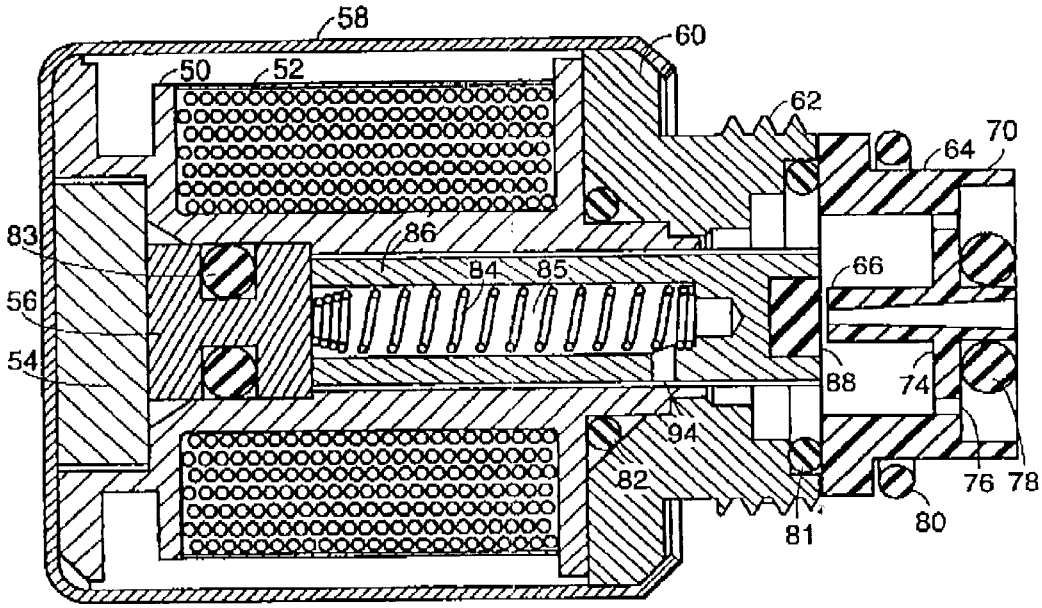
FIG. 4 is a more-detailed cross-sectional view of that operator.

The pilot-valve-operator assembly 40, of which FIG. 3 is an exploded view and FIG. 4 is a more-detailed cross-section, includes a bobbin 50 about which windings 52 are wound. A ferromagnetic pole piece 54 and, in latching versions of the operator, a permanent magnet 56 are disposed in recesses that the bobbin 50 forms at its left end. A solenoid can 58 is crimped at its right end to hold a right pole piece 60 against the bobbin 50 and thereby secure within the can 58 the bobbin 50, windings 52, left pole piece 54, and magnet 56. As FIG. 2 shows, the right pole piece 60 forms exterior threads 62 that engage complementary threads formed by the pilot housing 48, and the operator assembly 40 is thereby mounted on the pressure cap 24.

This mounting of the pilot-valve-actuator assembly 40 also secures within the pilot housing 48 a pilot body member 64. That member forms a central tube 66 by which, when the operator permits it, water from the pilot entrance passageway 44 can flow through a pilot opening 68 to the pilot exit passage 46 and from there through the through-diaphragm feed tube 38 to the flush passage 32, as was previously mentioned. The pilot body member 64 forms legs 70 that space from a pilot-housing-recess wall 72 a pilot-body-member wall 74 that forms openings 76 by which the water in the pilot entrance passageway reaches the central tube 66's entrance. An O-ring 78 seals between the central tube 66 and the recess wall 72 to prevent water from flowing from the pilot entrance passageway 44 into the pilot-body outlet opening 68 without having first flowed through the pilot body member's central tube 66. Another O-ring 80 is provided to prevent flow around the pilot body, while a further O-ring 81 seals between the pilot body member 64 and the right pole piece 60, and yet another O-ring 82 seals between the right pole piece and the bobbin. Finally, a further O-ring 83 prevents liquid in the bobbin 50's central void from escaping around pole piece 54.

An actuator spring 84 disposed in the control bore 85 of a ferromagnetic actuator 86 so acts between the left pole piece 54 and the actuator 86 as to tend to keep a resilient valve member 88 seated on a valve seat that the central tube 66's left end forms. With member 88 thus seated, water cannot flow from the pilot entrance passage 44 to the pilot exit passage 46. So the pressure in the main-valve pressure chamber 36 cannot exhaust through the pilot body member's central tube 66, and it therefore keeps the main valve closed by causing diaphragm 28 to bear against its seat 30.

To flush the toilet 18, the control circuit 42 drives current through the solenoid windings 52 and thereby generates a magnetic field that tends to concentrate in a flux path including the ferromagnetic actuator 86, the pole pieces 54 and 60, and the solenoid can 58. (The can may be made of, say, 400-series stainless steel, whose magnetic permeability is relatively high for stainless steel.) The resultant magnetic force on the actuator 86 moves it to the left in FIG. 2 against the spring force and thereby lifts the pilot-valve member 88 from its seat. This permits flow through the pilot-valve body member's central tube 66 to relieve the main pressure chamber 36's pressure and thereby allow supply pressure in the entrance chamber to open the main valve, i.e., to lift diaphragm 28 off its seat 30.

In the embodiment illustrated in FIGS. 2, 3, and 4, the operator assembly includes a magnet 56, and the actuator's leftward movement places the actuator in a position in which the force from the magnet's field is great enough to overcome spring 84's force and thereby retain the pilot valve in the open state even after current no longer flows in the solenoid's windings 52. That is, the operator is of the latching variety. In non-latching versions, there is no such permanent magnet, so current must continue to flow if the pilot valve is to remain open, and the pilot valve can be closed again by simply removing the current drive. To close the pilot valve in the illustrated, latching-valve version, on the other hand, current must be driven through the windings in the reverse direction: it must be so driven that the resultant magnetic field counters the permanent-magnet field that the actuator experiences. This allows the spring 84 to re-seat the actuator 86 in a position in which the spring force is again greater than the magnetic force, and the actuator will remain in the pilot-valve-closed position when current drive is thereafter removed.

Note that the actuator's central void 85 communicates through a flow passage 94 with the space to the right of the actuator. Water can flow into the bobbin recess that contains the actuator, and, in the absence of that flow passage, the water's presence might present more viscous resistance to actuator motion than is desirable. The actuator flow passage's communication with the internal void 85 provides a low-flow-resistance path for the water to move back and forth in response to the actuator 86's motion.

Now, the actuator 86 in the arrangement of FIGS. 2, 3, and 4 comes into contact with the fluid (typically water) being controlled. If that fluid is corrosive, the actuator 86 is best made from a material that tends to resist corrosion. But a corrosion-resistance requirement tends to eliminate from consideration some of the more magnetically permeable materials. This is unfortunate, because the use of lower-magnetic-permeability materials can exact a cost: it increases the solenoid-current requirement and, possibly, the winding-conductor thickness.

Figure 5:
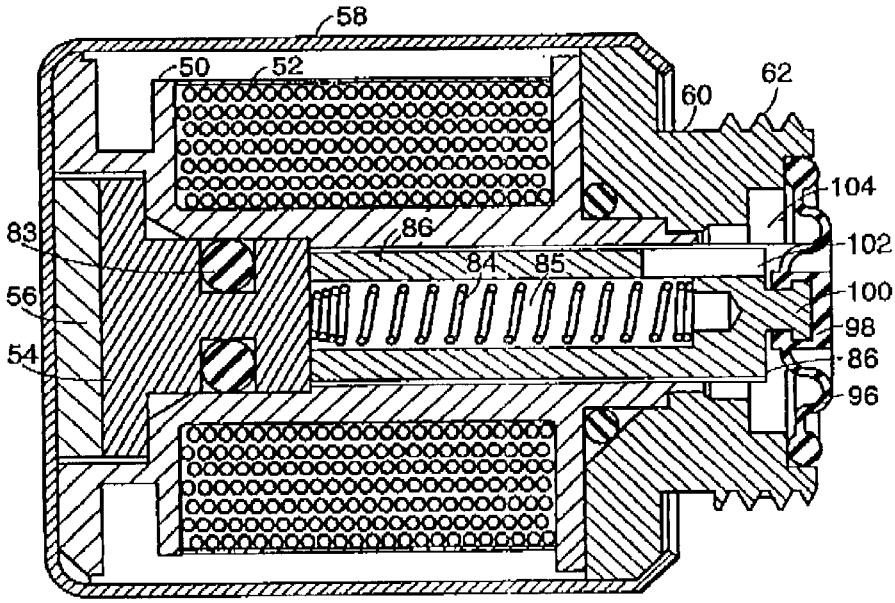
FIG. 5 is a cross-sectional view of an alternative, sealed version of the operator.
Figure 6:
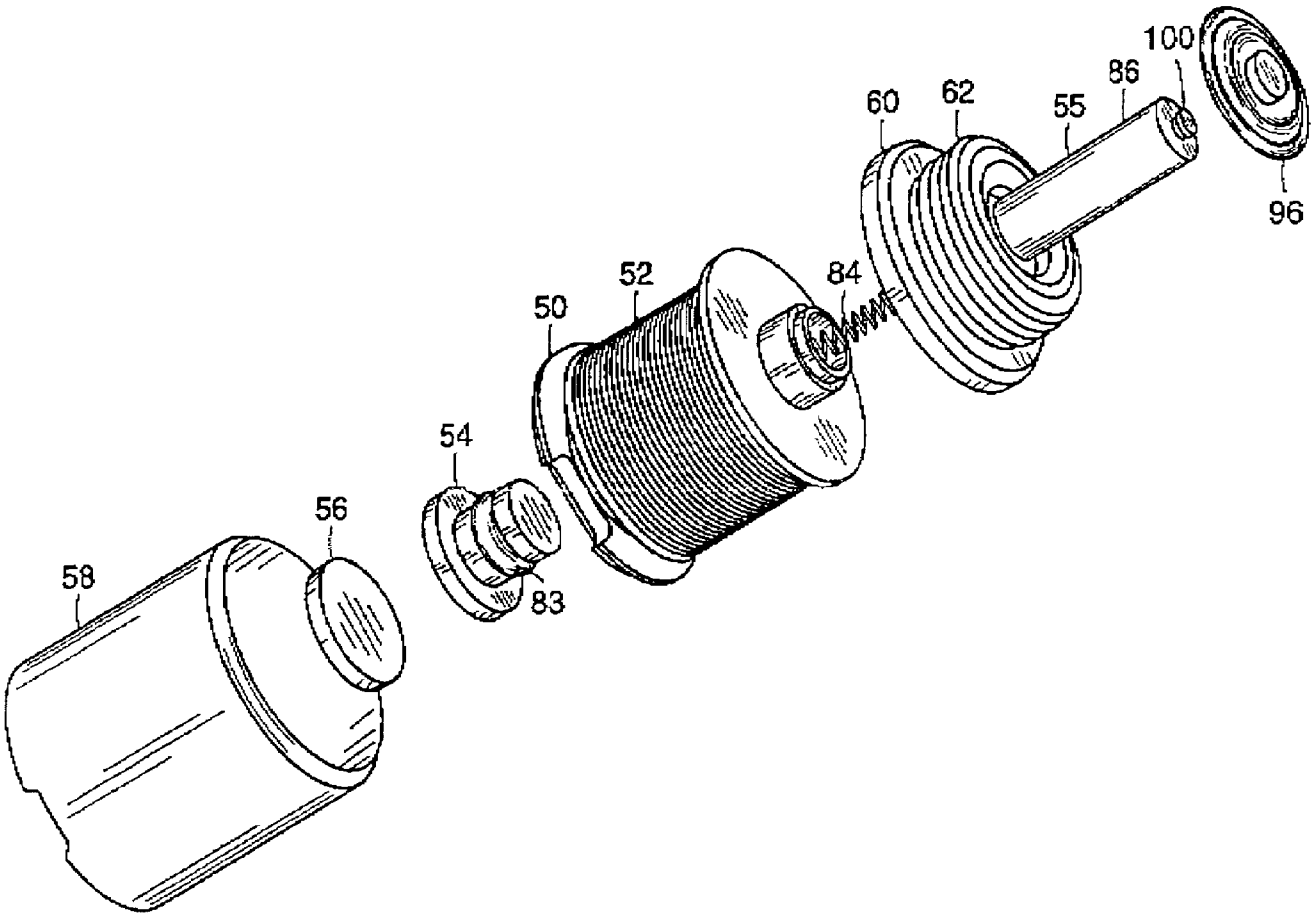
FIG. 6 is an exploded view of the operator of FIG. 5.

FIGS. 5 and 6 depict an arrangement that alleviates this disadvantage to an extent. With one main difference, FIG. 5's elements are essentially the same as those of FIG. 4, and corresponding parts are numbered identically. The main difference is that FIG. 5 replaces FIG. 4's O-ring 82 with an isolation diaphragm 96, which extends completely across the pole-piece opening to seal the actuator from exposure to the water that the valve controls. This reduces the need for the actuator 86 to be made of corrosion-resistance materials; it can be made of materials whose magnetic permeabilities are relatively high.

In the arrangement that FIGS. 5 and 6 illustrate, FIG. 4's resilient valve member 88 is replaced with a thickened region 98 in a C-shaped portion of the diaphram 96. That diaphragm portion is snap fit onto an actuator head portion 100 provided for that purpose. The FIG. 5 arrangement provides a slot 102 in the actuator 86 to provide a low-flow-resistance flow path similar to FIG. 4's radially extending passage 94. The FIG. 5 arrangement needs a flow path despite being sealed from the liquid being controlled because, in order to balance the pressure that the controlled liquid exerts on the diaphragm 96's outer face, some other liquid is provided in a reservoir 104 defined by the diaphragm 96 and extending into the actuator 86's central void 85. This fluid must flow through that void as the actuator moves, and the slot 102 provides a low-resistance path for this to occur. The reservoir liquid should be of a type that is less corrosive than the fluid being controlled. The reservoir liquid can simply be water, in which case it would typically be distilled water or water that otherwise contains relatively few corrosive contaminants. Alcohol is another choice. The choice of reservoir is not critical, but most users will find it preferable for the liquid to be non-toxic and relatively inviscid.

Figure 7:
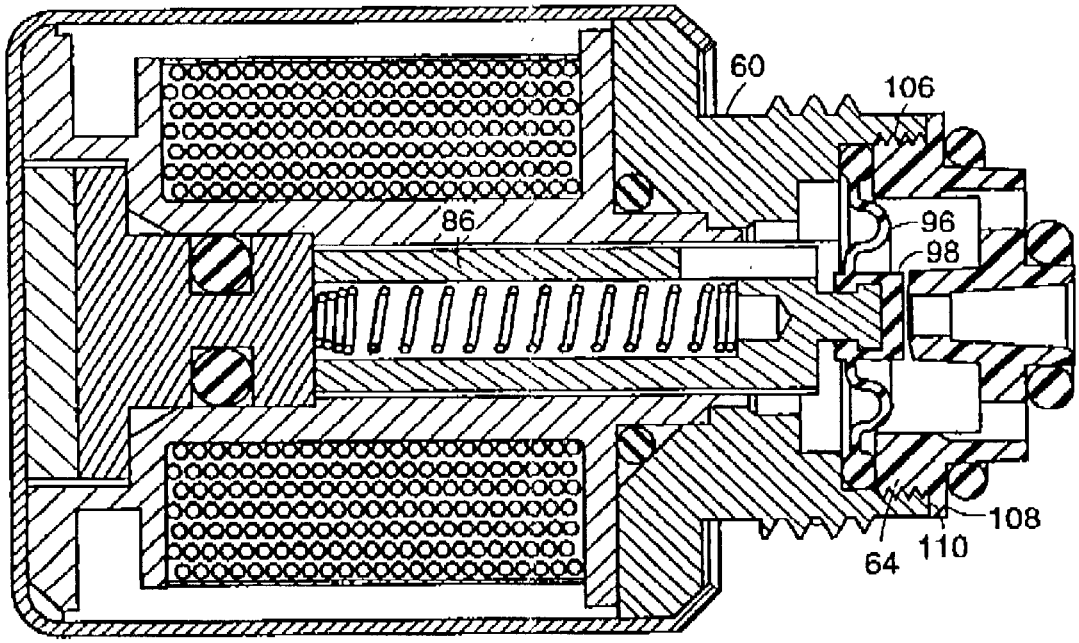
FIG. 7 is a cross-sectional view of another alternative version of the operator.
Figure 8:
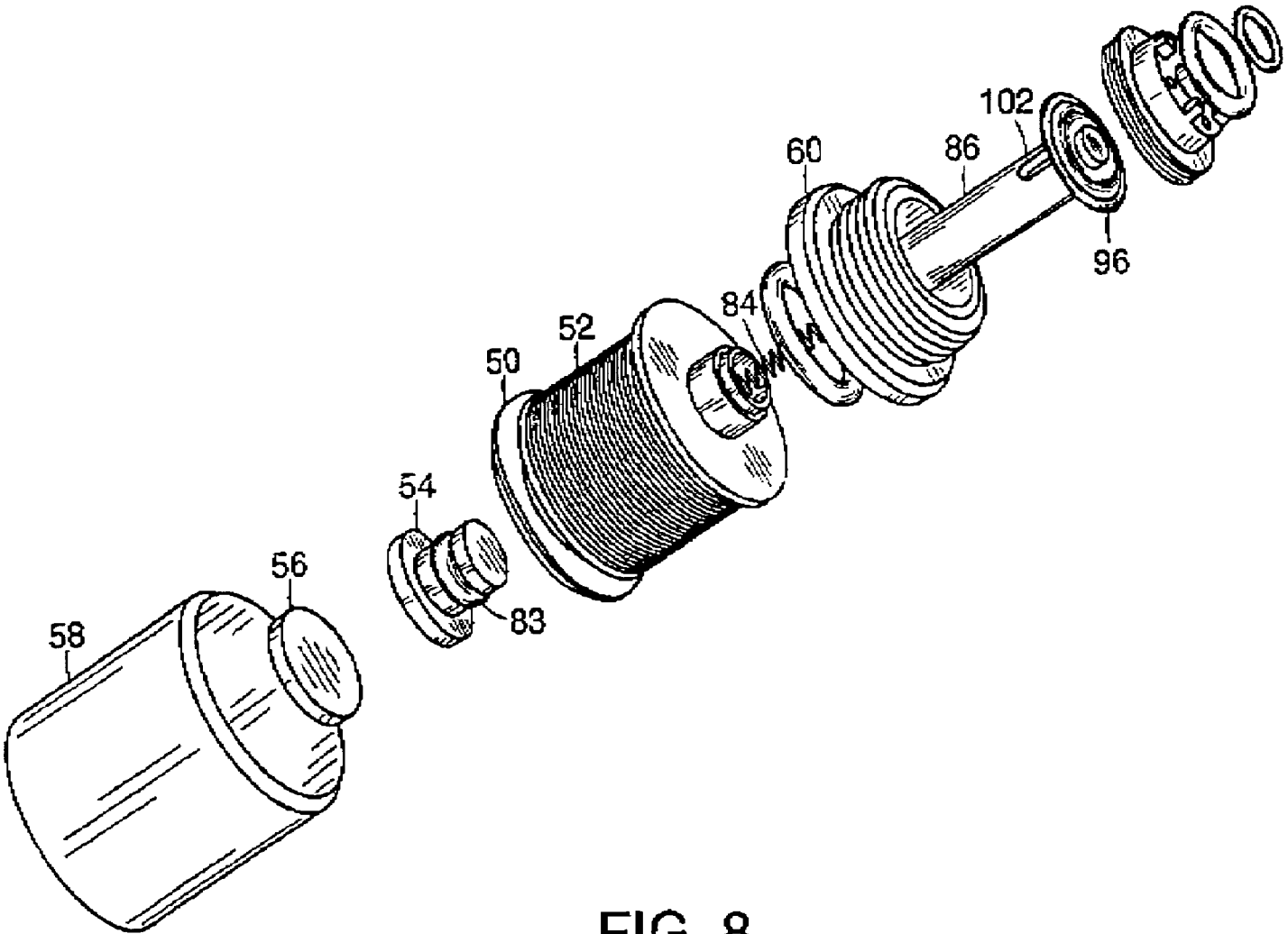
FIG. 8 is an exploded view of the operator of FIG. 7.

FIGS. 7 and 8 illustrate yet another version of the operator. This version is distinguished by the fact that the pilot body member 64 is secured to the operator assembly. Specifically, the body member 64 is provided with threads 106 that engage complementary threads provided by the right pole piece 60. In the particular embodiment that FIG. 7 illustrates, the pilot body member forms a flange 108. That flange so butts against a shoulder portion 110 of the right pole piece 60 as to act as a positive stop to the pilot body member's being screwed onto the operator.

The advantage of thus securing the pilot body can be appreciated best by contrasting this version with that of FIG. 4. In FIG. 4, the body member 64 is secured in place as a result of the operator's being screwed into position in the pilot housing. Various piece-part tolerances and the deformability of O-rings 78 and 81 result in some variability in the position of the pilot body's central tube 66 with respect to the resilient valve member 88. This variability can cause resultant variability in the flusher's open and close times. The variability can be reduced to within acceptable levels during manufacturing by taking care in the assembly of the operator onto the pilot housing. During field maintenance and/or replacement, though, such care is less practical to provide. In the arrangement of FIG. 7, on the other hand, the pilot-valve/seat spacing is set when the pilot member is assembled onto the operator, and this setting can be made quite repeatable, as the FIG. 7 arrangement illustrates in its use of the flange 108 and shoulder 110. Of course, other ways of providing a positive stop when the pilot body is assembled to the operator can be employed instead.

Although the FIG. 7 arrangement is of the isolated variety, i.e., of the type that employs a diaphragm 96 to keep the controlled fluid from coming into contact with the actuator 86, it will be appreciated that the repeatability advantages of mounting the pilot body on the operator can also be afforded in non-isolated arrangements.

We now turn to the system for controlling the operator. As FIG. 2 shows, the operator-control circuitry 42 is contained in a circuit housing formed of three parts, a front piece 116, a center piece 118, and a rear piece 120. Screws not shown secure the front piece 116 to the center piece 118, to which the rear piece 120 is in turn secured by screws such as screw 122. That screw threadedly engages a bushing 124 ultrasonically welded into a recess that the center housing piece 118 forms for that purpose. A main circuit board 126, on which are mounted a number of components such as a capacitor 128 and a microprocessor not shown, is mounted in the housing. An auxiliary circuit board 130 is in turn mounted on the main circuit board 126. Mounted on the auxiliary board 130 is a light-emitting diode 132, which a transmitter hood 134 also mounted on that board partially encloses. The front circuit-housing piece 116 forms a transmitter-lens portion 136, which has front and rear polished surfaces 138 and 140. The transmitter-lens portion focuses infrared light from light-emitting diode 132 through an infrared-transparent window 144 formed in the flusher housing 146. FIG. 1's pattern 148 represents the resultant radiation-power distribution. A receiver lens 152 formed by part 116 so focuses received light onto a photodiode 154 mounted on the main circuit board 126 that FIG. 1's pattern 150 of sensitivity to light reflected from targets results.

Like the transmitter light-emitting diode 132, the photodiode 154 is provided with a hood, in this case hood 156. The hoods 134 and 156 are opaque and tend to reduce noise and crosstalk. The circuit housing also limits optical noise; its center and rear parts 118 and 120 are made of opaque material such as Lexan 141 polycarbonate, while its front piece 116, being made of transparent material such as Lexan OQ2720 polycarbonate so as to enable it to form effective lenses 136 and 152, has a roughened and/or coated exterior in its non-lens regions that reduces transmission through it. An opaque blinder 158 mounted on front piece 116 leaves a central aperture 160 for infrared-light transmission from the light-emitting diode 132 but otherwise blocks stray transmission that could contribute to crosstalk. Also to prevent crosstalk, an opaque stop 162 is secured into a slot provided for that purpose in the circuit housing's front part 116.

Figure 9:
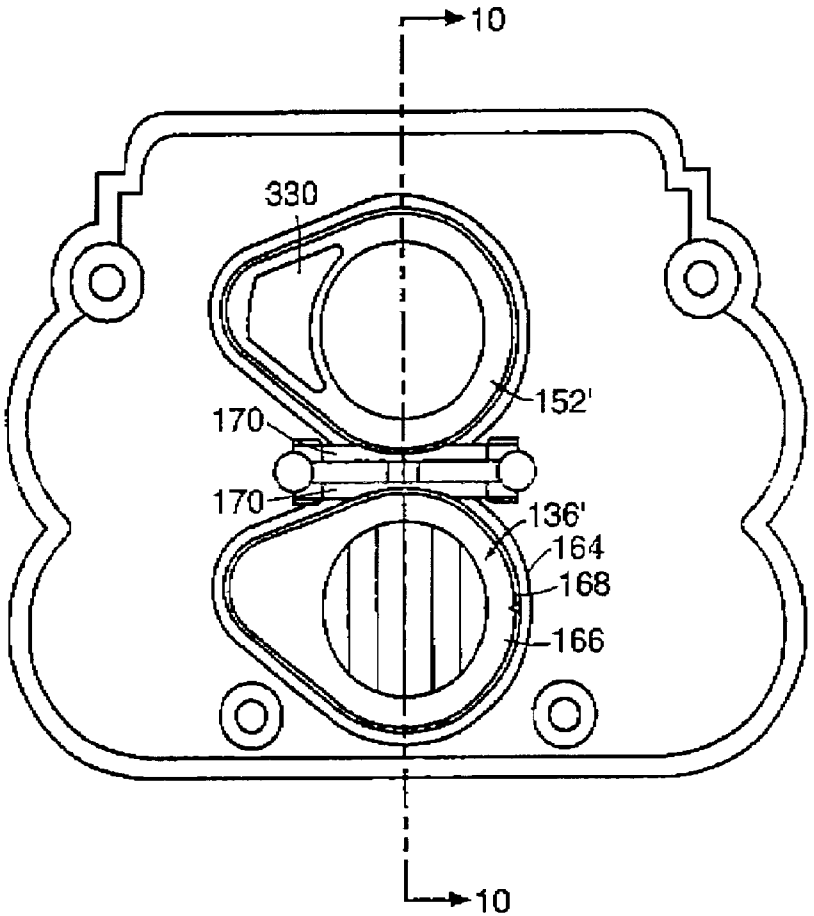
FIG. 9 is a front elevation of an alternative version's transmitter and receiver lenses and front circuit-housing part.
Figure 10:
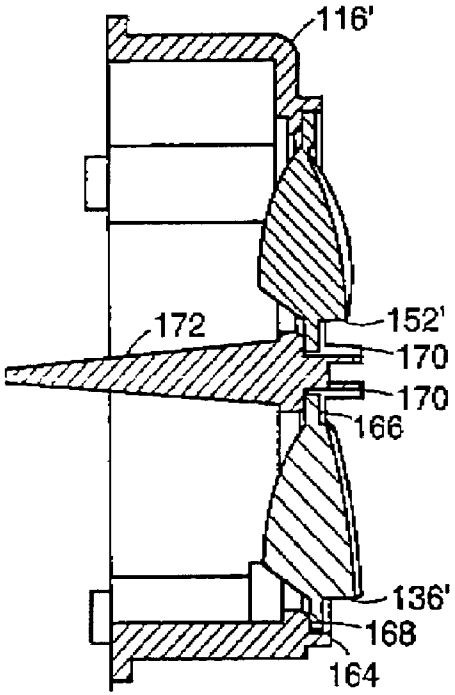
FIG. 10 is a cross-section taken at line 10—10 of FIG. 9.

The arrangement of FIG. 2, in which the transmitter and receiver lenses are formed integrally with part of the circuit housing, can afford manufacturing advantages over arrangements in which the lenses are provided separately from the housing. But it may be preferable in some embodiments to make the lenses separate, because doing so affords greater flexibility in material selection for both the lens and the circuit housing. FIGS. 9 and 10 are front-elevational and cross-sectional views of an alternative that uses this approach. That alternative includes a front circuit housing piece 116' separate from lenses 136' and 152'. The housing part 116' forms a teardrop-shaped rim 164 that cooperates during assembly with a similarly shaped flange 166 on lens 136' to orient that lens properly in its position on a teardrop-shaped shoulder 168 to which it is then welded ultrasonically. The teardrop shape ensures that the lens is oriented properly, and FIGS. 9 and 10 show that the receiver lens 152' is mounted similarly. Since the front circuit-housing part 116' and lenses 136' and 152' do not need to be made of the same material, housing part 116' can be made of an opaque material so that blinders 170 and a stop 172 can be formed integrally with it.

Figure 11:
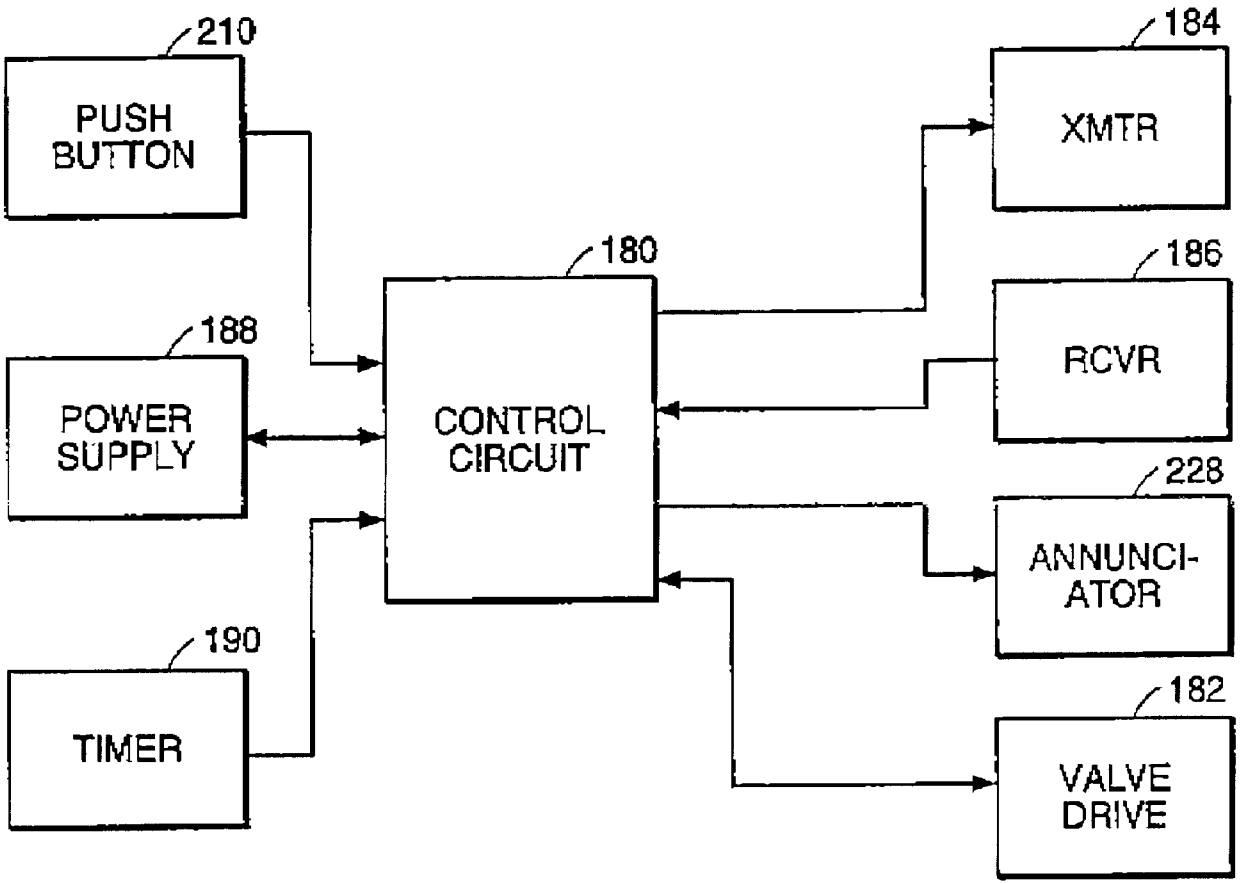
FIG. 11 is a block diagram of the flusher's control circuitry.

As was mentioned in connection with FIG. 2, the circuit housing contains circuitry that controls the valve operator as well as other flusher components. FIG. 11 is a simplified block diagram of that circuitry. A microcontroller-based control circuit 180 operates a peripheral circuit 182 that controls the valve operator. Transmitter circuitry 184, including FIG. 2's light-emitting diode 132, is also operated by the control circuit 180, and receiver circuitry 186 includes the photodiode 154 and sends the control circuit its response to resultant echoes. Although the circuitry of FIG. 11 can be so implemented as to run on house power, it is more typical for it to be battery-powered, and FIG. 11 explicitly shows a battery-based power supply 188 because the control circuit 180, as will be explained below, not only receives regulated power from the power supply but also senses its unregulated power for purposes to be explained below. It also controls application of the supply's power to various of the FIG. 11 circuit's constituent parts.

Figures 12, 12A:
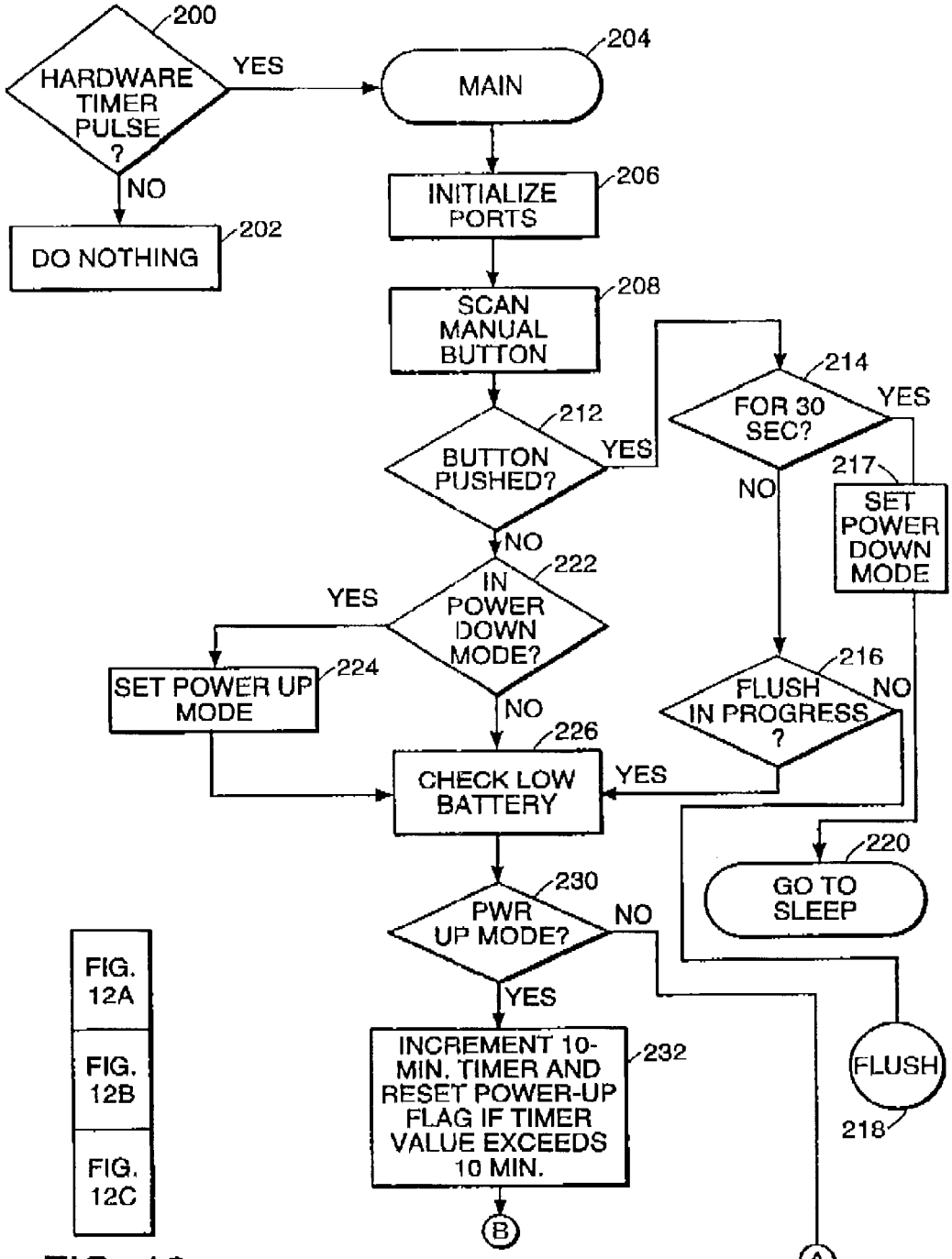
FIGS. 12A, 12B, and 12C together form a simplified flow chart a routine that the control circuitry of FIG. 11 executes.
Figure 12B:
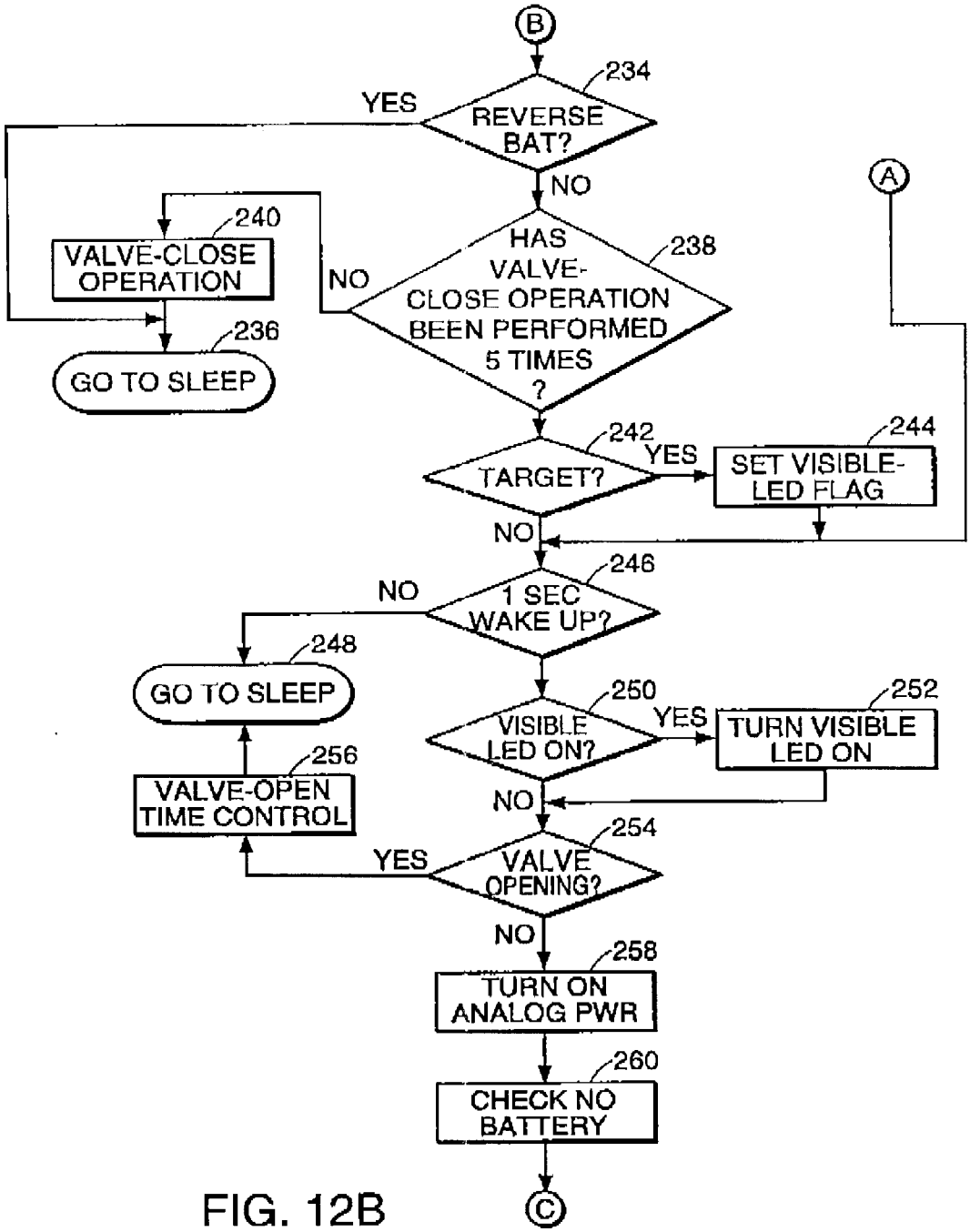
Figure 12C:
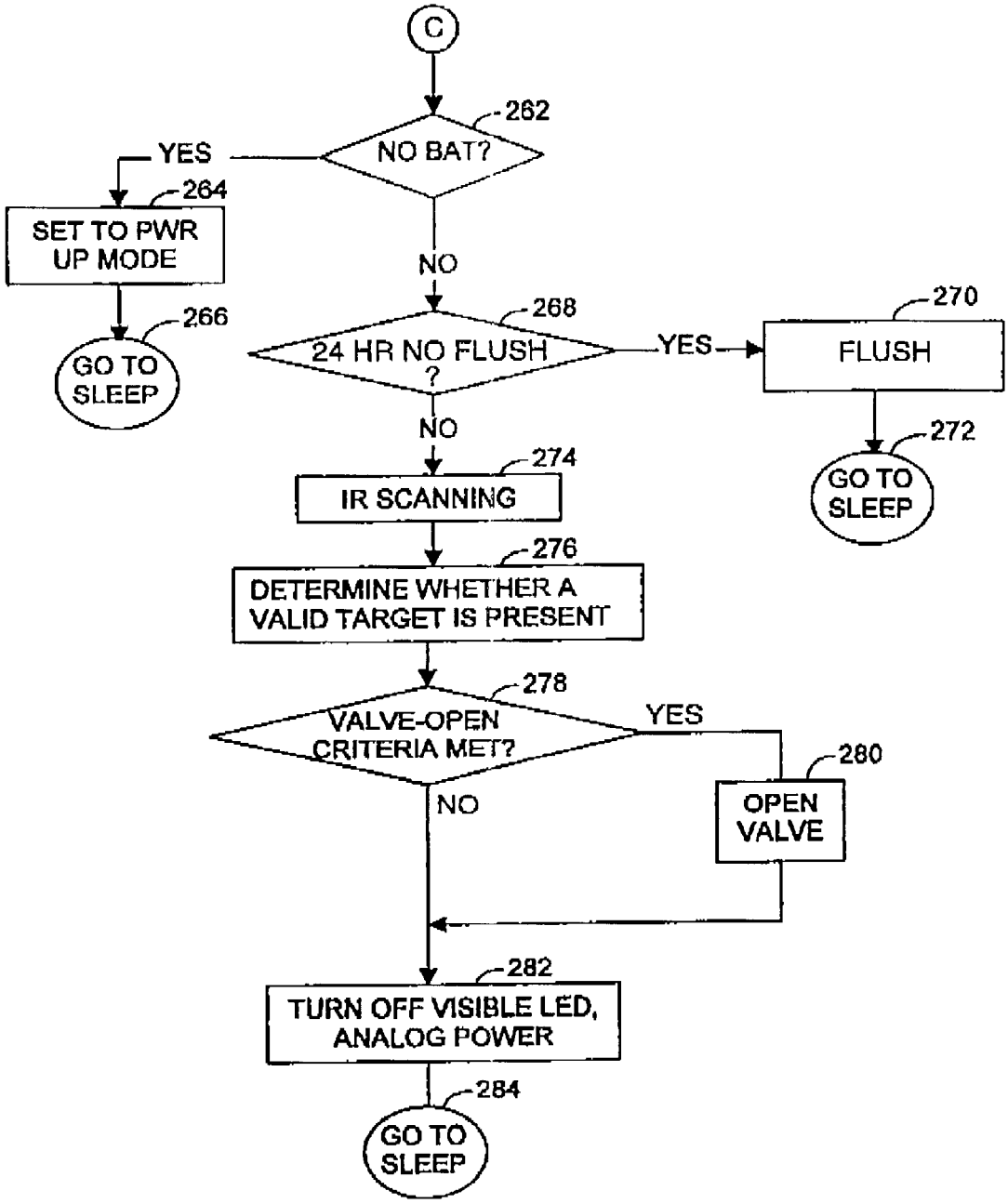

Since the circuitry is most frequently powered by battery, an important design consideration is that power not be employed unnecessarily. As a consequence, the microcontroller-based circuitry is ordinarily in a "sleep" mode, in which it draws only enough power to keep certain volatile memory refreshed and operate a timer 190. In the illustrated embodiment, that timer 190 generates an output pulse every 250 msec., and the control circuit responds to each pulse by performing a short operating routine before returning to the sleep mode. FIGS. 12A and 12B (together, "FIG. 12") form a flow chart that illustrates certain of those operations' aspects in a simplified fashion.

Blocks 200 and 202 represent the fact that the controller remains in its sleep mode until timer 190 generates a pulse. When the pulse occurs, the processor begins executing stored programming at a predetermined entry point represented by block 204. It proceeds to perform certain initialization operations exemplified by block 206's step of setting the states of its various ports and block 208's step of detecting the state of FIG. 2's push button 210. That push button, which is mounted on the flusher housing 146 for ready accessibility by a user, contains a magnet 210*a* whose proximity to the main circuit board 126 increases when the button is depressed. The circuit board includes a reed switch 211 that, as FIG. 11 suggests, generates an input to the control circuit in response to the resultant increased magnetic field on circuit board 126.

Push button 210's main purpose is to enable a user to operate the flusher manually. As FIG. 12's blocks 212, 214, 216, 217, and 218 indicate, the control circuit 180 ordinarily responds to that button's being depressed by initiating a flush operation if one is not already in progress—and if the button has not been depressed continuously for the previous thirty seconds.

This thirty-second condition is imposed in order to allow batteries to be installed during manufacture without causing significant energy drain between the times when the batteries are installed in the unit and when the unit is installed in a toilet system. Specifically, packaging for the flusher can be so designed that, when it is closed, it depresses the push button 210 and keeps it depressed so long as the packaging remains closed. It will typically have remained closed in this situation for more than thirty seconds, so, as FIG. 12's block 220 shows, the controller returns to its sleep mode without having caused any power drain greater than just enough to enable the controller to carry out a few instructions. That is, the controller has not caused power to be applied to the several ciricuits used for transmitting infrared radiation or driving current through the flush-valve operator. Of course, the delay need not be thirty seconds, but its duration should be long enough that a user's operating the push button to operate the flusher will not ordinarily trigger the sleep mode. The delay will therefore be at least 30 seconds in most embodiments of the invention.

Among the ways in which the sleep mode conserves power is that the microprocessor circuitry is not clocked, but some power is still applied to that circuitry in order to maintain certain minimal register state, including predetermined fixed values in several selected register bits. When batteries are first installed in the flusher unit, though, not all of those register bits will have the predetermined values. Block 222 represents determining whether those values are present. If not, then the controller concludes that batteries have just been installed, and it enters a power-up mode, as block 224 indicates.

The power-up mode deals with the fact that the proportion of sensor radiation reflected back to the sensor receiver in the absence of a user differs in different environments. The power-up mode's purpose is to enable an installer to tell the system what that proportion is in the environment is which the flusher has been installed. This enables the system thereafter to ignore background reflections. During the power-up mode, the object sensor operates without opening the valve in response to target detection. Instead, it operates a visible LED whenever it detects a target, and the installer adjusts, say, a potentiometer to set the transmitter's power to a level just below that at which, in the absence of a valid target, the visible LED's illumination nonetheless indicates that a target has been detected. This tells the system what level will be considered the maximum radiation level permissible for this installation.

Among the steps involved in entering this power-up mode is to apply power to certain subsystems that must remain on continually if they are to operate. Among these, for instance, is the sensor's receiver circuit. Whereas the infrared transmitter needs only to be pulsed, and power need not be applied to it between pulses, the receiver must remain powered between pulses so that it can detect the pulse echoes.

Another subsystem that requires continuous power application in the illustrated embodiment is a low-battery detector. As was mentioned above, the control circuitry receives an unregulated output from the power supply, and it infers from that output's voltage whether the battery is running low, as block 226 indicates. If it is low, then a visible-light-emitting diode or some other annunciator, represented in FIG. 11 by block 228, is operated to give the user an indication of the low-battery state.

Now, the battery-check operation that block 226 represents can be reached without the system's having performed block 224's operation in the same cycle, so block 226's battery-check operation is followed by the step, represented by block 230, of determining whether the system currently is in the power-up mode.

In the illustrated embodiment, the system is arranged to operate in this power-up mode for ten minutes, after which the installation process has presumably been completed and a visible target-detection indicator is no longer needed. If, as determined in the block-230 operation, the system is indeed in the power-up mode, it performs block 232's step of determining whether it has been in that mode for more than ten minutes, the intended length of the calibration interval. If so, it resets the system so that it will not consider itself to be in the power-up mode the next time it awakens.

For the current cycle, though, it is still in its power-up mode, and it performs certain power-up-mode operations. One of those, represented by block 234, is to determine from the unregulated power-supply output whether any of the batteries have been installed in the wrong direction. If any have, the system simply goes back to sleep, as block 236 indicates. Otherwise, as block 238 indicates, the system checks its memory to determine whether it has commanded the valve operator five times in a row to close the flush valve, as the illustrated embodiment requires in the power-up mode. We have found that thus ordering the valve to close when the system is first installed tends to prevent inadvertent flushing during initial installation.

As block 242 indicates, the system then determines whether a target has been detected. If is has, the system sets a flag, as block 244 indicates, to indicate that the visible LED should be turned on and thereby notify the installer of this fact. This completes the power-up-mode-specific operations.

The system then proceeds with operations not specific to that mode. In the illustrated embodiment, those further operations actually are intended to be performed only once every second, whereas the timer wakes the system every 250 msec. As block 246 indicates, therefore, the system determines whether a full second has elapsed since the last time it performed the operations that are to follow. If not, the system simply goes back to sleep, as block 248 indicates.

If a full second has elapsed, on the other hand, the system turns on a visible LED if it had previously set some flag to indicate that this should be that LED's state. This operation, represented by blocks 250 and 252, is followed by block 254's step of determining whether the valve is already open. If it is, the routine calls a further routine, represented by block 256, in which it consults timers, etc. to determine whether the valve should be closed. If it should, the routine closes the valve. The system then returns to the sleep mode.

If the valve is not already open, the system applies power, as block 258 indicates, to the above-mentioned subsystems that need to have power applied continuously. Although that power will already have been applied if this step is reached from the power-up mode, it will not yet have been applied in the normal operating mode.

That power application is required at this point because the subsystem that checks battery power needs it. That subsystem's output is then tested, as blocks 260 and 262 indicate. If the result is a conclusion that battery power is inadequate, then the system performs block 264's and block 266's steps of going back to sleep after setting a flag to indicate that it has assumed the power-up mode. Setting the flag causes any subsequent wake cycle to include closing the valve and thereby prevents uncontrolled flow that might otherwise result from a power loss.

Now, it is desirable from a maintenance standpoint for the system not to go too long without flushing. If twenty-four hours have elapsed without the system's responding to a target by flushing, the routine therefore causes a flush to occur and then goes to sleep, as blocks 268, 270, and 272 indicate. Otherwise, the system transmits infrared radiation into the target region and senses any resultant echoes, as block 274 indicates. It also determines whether the resultant sensed echo meets certain criteria for a valid target, as block 276 indicates.

The result of this determination is then fed to a series of tests, represented by block 278, for determining whether flushing should occur. A typical test is to determine whether a user has been present for at least a predetermined minimum time and then has left, but several other situations may also give rise to a determination that the valve should be opened. If any of these situations occurs, the system opens the valve, as block 280 indicates. If the visible LED and analog power are on at this point, they are turned off, as block 282 indicates. As block 284 indicates, the system then goes to sleep.

Figures 13, 13A:
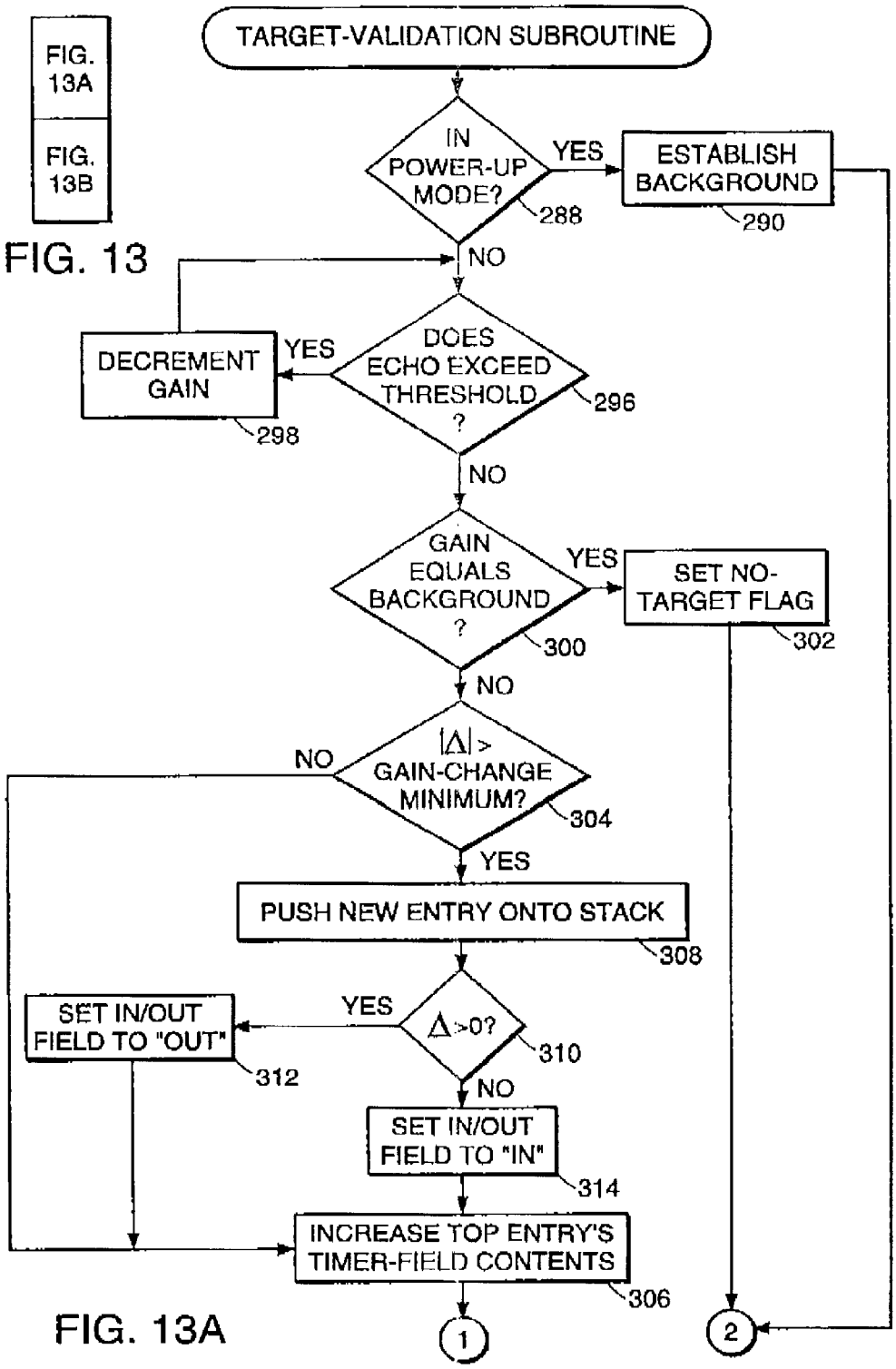
FIGS. 13A and 13B together form a more-detailed flow chart of a step in the routine of FIGS. 12A, 12B, and 12C.
Figure 13B:
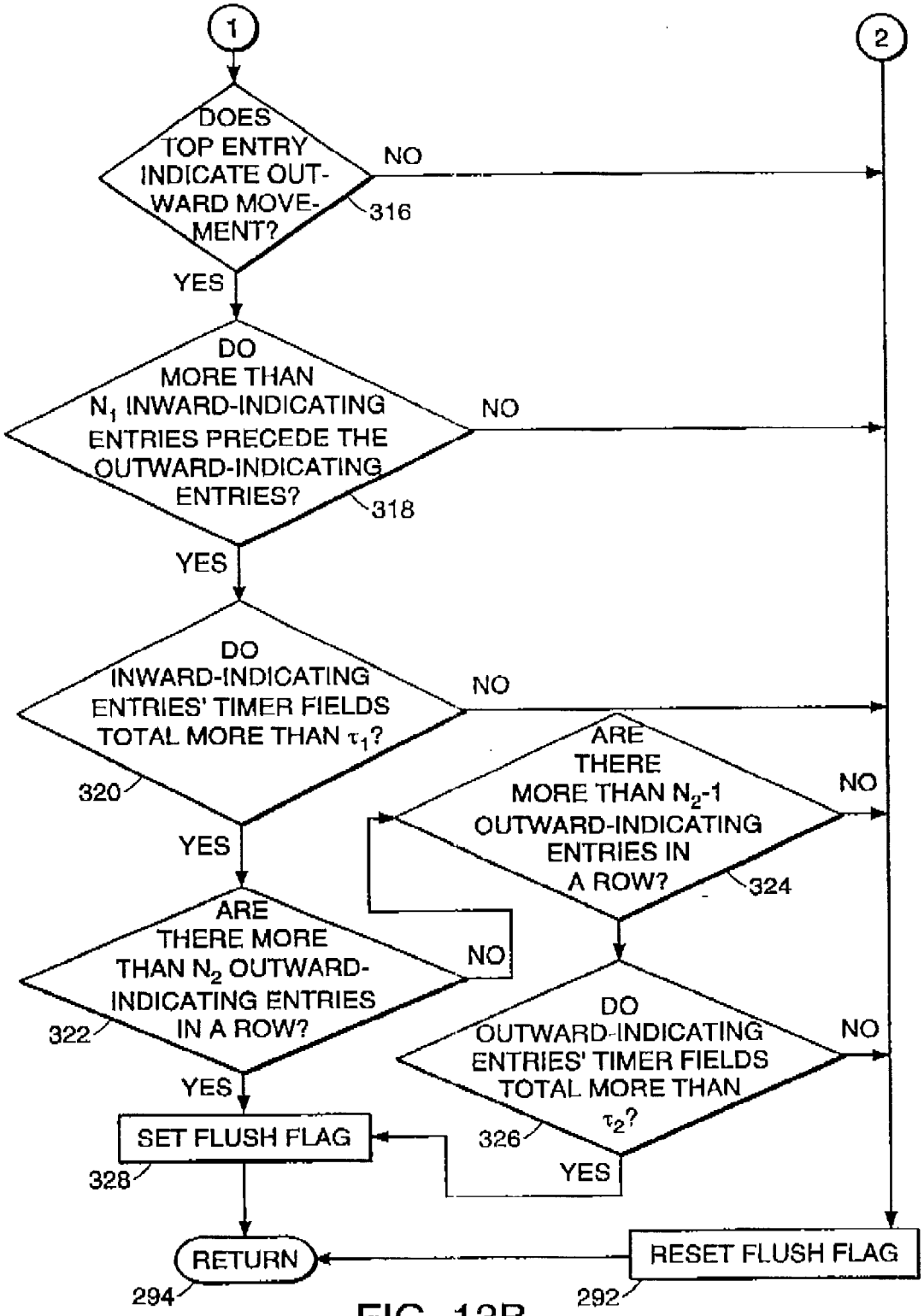

Block 276's operation of determining whether a valid target is present includes a routine that FIGS. 13A and 13B together, ("FIG. 13") depict. If, as determined in the step represented by that drawing's block 288, the system is in its power-up mode, then a background gain is established in the manner explained above. Block 290 represents determining that level.

The power-up mode's purpose is to set a background level, not to operate the flush valve, so the background-determining step 290 is followed by the block-292 operation of resetting a flag that, if set, would cause other routines to open the flush valve. The FIG. 13 routine then returns, as block 294 indicates.

If the step of block 288 instead indicates that the system is not in the power-up mode, the system turns to obtaining an indication of what percentage of the transmitted radiation is reflected back to the sensor. Although any way of obtaining such an indication is suitable for use with the present invention, a way that tends to conserve power is to vary the transmitted power in such a way as to find the transmitted-power level that results in a predetermined set value of received power. The transmitted-power level thereby identified is an (inverse) indication of the reflection percentage. By employing this approach, the system can so operate as to limit its transmission power to the level needed to obtain a detectable echo.

In principle, the illustrated embodiment follows this approach. In practice, the system is arranged to transmit only at certain discrete power levels, so it in effect identifies the pair of discrete transmitted-power levels in response to which the reflected-power levels bracket the predetermined set value of received power. Specifically, it proceeds to block 296's and block 298's steps of determining whether the intensity of the reflected infrared light exceeds a predetermined threshold and, if it does, reducing the system's sensitivity—typically by reducing the transmitted infrared-light intensity—until the reflected-light intensity falls below the threshold. The result is the highest gain value that yields no target indication.

In some cases, though, the reflected-light intensity falls below the threshold even when, if the sensitivity were to be increased any further, the system would (undesirably) detect background objects, such as stall doors, whose presence should not cause flushing. The purpose of block 290's step was to determine what this sensitivity was, and the steps represented by blocks 300 and 302 set a no-target flag if the infrared echo is less than the threshold even with the gain at this maximum, background level. As the drawing shows, this situation also results in the flush flag's being reset and the routine's immediately returning.

If the block-300 step instead results in an indication that the echo intensity can be made lower than the threshold return only if the sensitivity is below the background level, then there is a target that is not just background, and the routine proceeds to steps that impose criteria intended to detect when a user has left the facility after having used it. To impose those criteria, the routine maintains a push-down stack onto which it pushes entries from time to time. Each entry has a gain field, a timer field, and an in/out field.

Block 304 represents determining whether the absolute value of the difference between the current gain and the gain listed in the top stack entry exceeds a threshold gain change. If it does not, the current call of this routine results in no new entry's being pushed onto the stack, but the contents of the existing top entry's timer field are incremented, as block 306 indicates. If the block-304 step's result is instead that the gain change's absolute value was indeed greater than the threshold, then the routine pushes a new entry on to the stack, placing the current gain in that entry's gain field and giving the timer field the value of zero. In short, a new entry is added whenever the target's distance changes by a predetermined step size, and it keeps track of how long the user has stayed in roughly the same place without making a movement as great as that step size.

As blocks 310, 312, and 314 indicate, the routine also gives the entry's in/out field an "out" value, indicating that the target is moving away from the flusher, if the current gain exceeds the previous entry's gain, and it gives that field an "in" value if the current gain is less than the previous entry's gain. In either case, the routine then performs the block-306 step of incrementing the timer (to a value of "1") and moves from the stack-maintenance part of the routine to the part in which the valve-opening criteria are actually applied.

Block 316 represents applying the first criterion, namely, whether the top entry's in/out field indicates that the target is moving away. If the target does not meet this criterion, the routine performs the block-292 step of setting the flush flag to the value that will cause subsequent routines not to open the flush valve, and the routine returns, as block 294 indicates. If that criterion is met, on the other hand, the routine performs block 318's step of determining whether the top entry and any immediately preceding entries indicating that the target is moving away are preceded by a sequence of a predetermined minimum number of entries that indicated that the target was moving in. If they were not, then it is unlikely that a user had actually approached the facility, used it, and then moved away, so the routine again returns after resetting the flush flag. Note that the criterion that the block-318 step applies is independent of absolute reflection percentage; it is based only on reflection-percentage changes, requiring that the reflection percentage traverse a minimum range as it increases.

If the step of block 318 instead determines that the requisite number of inward-indicating entries did precede the outward-indicating entries, then the routine imposes the block-320 criterion of determining whether the last inward-movement-indicating entry has a timer value representing at least, say, 5 seconds. This criterion is imposed to prevent a flush from being triggered when the facility was not actually used. Again, the routine returns after resetting the flush flag if this criterion is not met.

If it is met, on the other hand, then the routine imposes the criteria of blocks 322, 324, and 326, which are intended to determine whether a user has moved away adequately. If the target appears to have moved away by more then a threshold amount, as determined by block 322, or has moved away slightly less but has appeared to remain at that distance for greater then a predetermined duration, as determined in blocks 324 and 326, then, as block 328 indicates, the routine sets the flush flag before returning. Otherwise, it resets the flush flag.

The test of FIG. 13 is typically only one of the various tests that FIG. 12B's operation 276 includes. But it gives an example of how the illustrated system reduces problems that variations in user-clothing colors would otherwise make more prevalent. As a perusal of FIG. 13 reveals, a determination of whether a user has arrived and/or left is based not on absolute gain values but rather on relative values, which result from comparing successive measurements. This reduces the problem, which afflicts other detection strategies more severely, of greater sensitivity to light-colored clothing than to dark-colored clothing.

It was mentioned above that the illustrated system employs a visible-light-emitting diode ("visible LED"). In most cases, the visible LED's location is not crucial, so long as a user can really see its light. One location, for instance, could be immediately adjacent to the photodiode; FIG. 9 shows a non-roughened region 330 in the flange of receiver-lens part 152', and the visible LED could be disposed in registration with this region. In the embodiment of FIG. 2, though, no such separate visible LED is apparent. The reason why is that the visible LED in that embodiment is provided as a part of a combination-LED device 132, which also includes the transmitter's infrared source.

Figure 14:
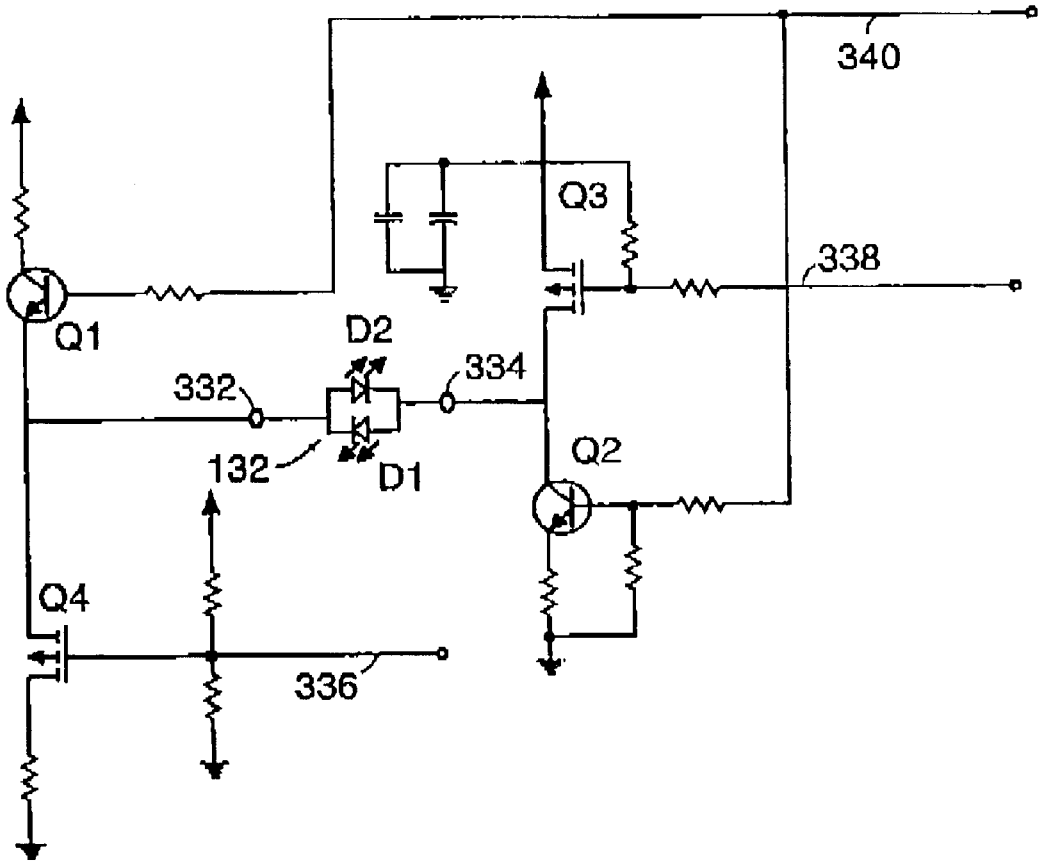
FIG. 14 is a schematic diagram of the circuitry that the flusher uses to drive its light-emitting diodes.

To operate the two-color LED, FIG. 11's transmitter and annunciator circuits 184 and 228 together take the form shown in FIG. 14. That circuitry is connected to the two-color LED's terminals 332 and 334. The control circuit separately operates the two-color LED's infrared-light-emitting diode D1 and the visible-light-emitting diode D2 by driving control lines 336, 338, and 340 selectively. Specifically, driving line 340 high turns on transistors Q1 and Q2 and thereby drives the visible-light-emitting diode D2, at least if line 338 is held high to keep transistor Q3 turned off. If line 340 is driven low, on the other hand, and line 338 is also driven low, then infrared-light-emitting diode D1 is allowed to conduct, with a power that is determined by the voltage applied to a line 336 that controls transistor Q4.

Figure 15:
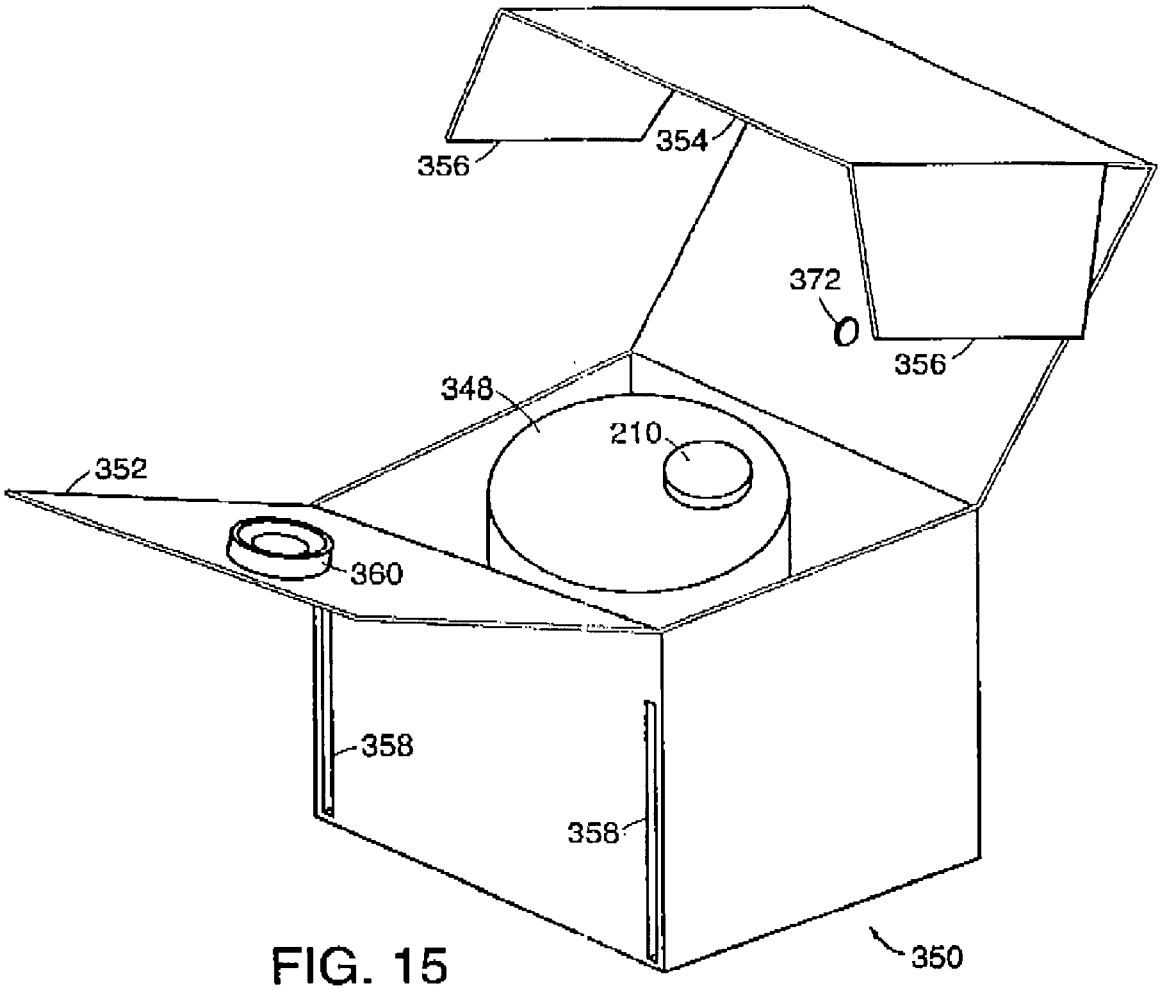
FIG. 15 is an isometric view of a container that may be employed for a flusher conversion kit of the type depicted in FIG. 2.

It was stated above in connection with FIG. 12's blocks 214, 217, and 220 that the system goes to sleep if the push button has remained depressed for over 30 seconds. FIG. 15 illustrates packaging that takes advantage of this feature to keep power use negligible before the kit is installed, even if the kit includes installed batteries while it is in inventory or being transported. To adapt a previously manual system to automatic operation, a prospective user may acquire a flow controller that, for example, contains all of the elements depicted in FIG. 2A except the through-diaphragm feed tube 38. This flow controller, identified by reference numeral 348 in FIG. 15, is delivered in a container comprising a generally rectangular cardboard box 350. The box's top includes an inner flap 352, which is closed first, and an outer flap 354, which is closed over the inner flap. Tabs 356 that fit into slots 358 provided in the box body keep the box closed. To keep the button depressed while the box is closed, the box is provided with a button activator 360 so mounted on the inner flap 352 that it registers with the push button 310 when that flap is closed. The package may be provided with inserts, not shown, to ensure that the flow controller's push button registers correctly with the activator.

Figure 16:
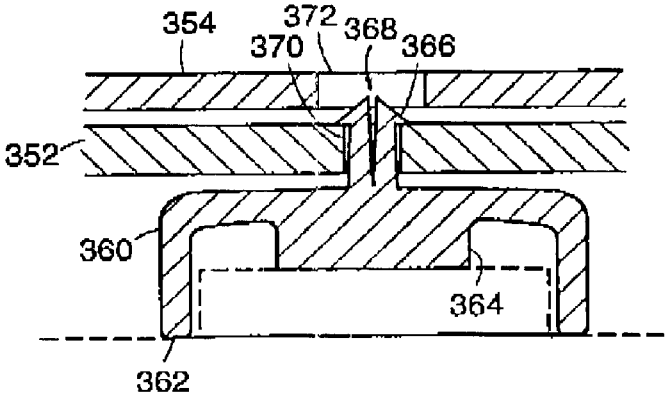
FIG. 16 is a detailed cross section of a button-depression device included in FIG. 16's container.

FIG. 16 is a detailed cross-sectional view of the button activator 360 showing it mounted on the inner flap 352 with the outer flap 354 closed over it. The illustrated activator 360 is typically a generally circular plastic part. It forms an annular stop ring 362, which engages the top of the flow controller's housing 146 (FIG. 2) to ensure that a central protuberance 364 depresses the push button by only the correct amount. To mount the activator 360 in the inner flap, it is provided with a barbed post 366. Post 366 forms a central slot 368 that enables it to deform so that its barbs can fit through a hole 370 in the inner flap 352. The outer flap 354 forms another hole 372 to accommodate the barbed post 366.

Other arrangements may place the button actuator elsewhere in the container. It may be placed on the container's bottom wall, for example, and the force of the top flaps against the flow controller.

Now, it sometimes occurs that the batteries are placed into the circuit even before it is assembled into the housing, and the circuit with the batteries installed may need to be shipped to a remote location for that assembly operation. Since there is as yet no housing, the circuitry cannot be kept asleep by keeping the housing's button depressed. For such situations, an approach that FIGS. 17 and 18 depict can be employed.

Figure 17:
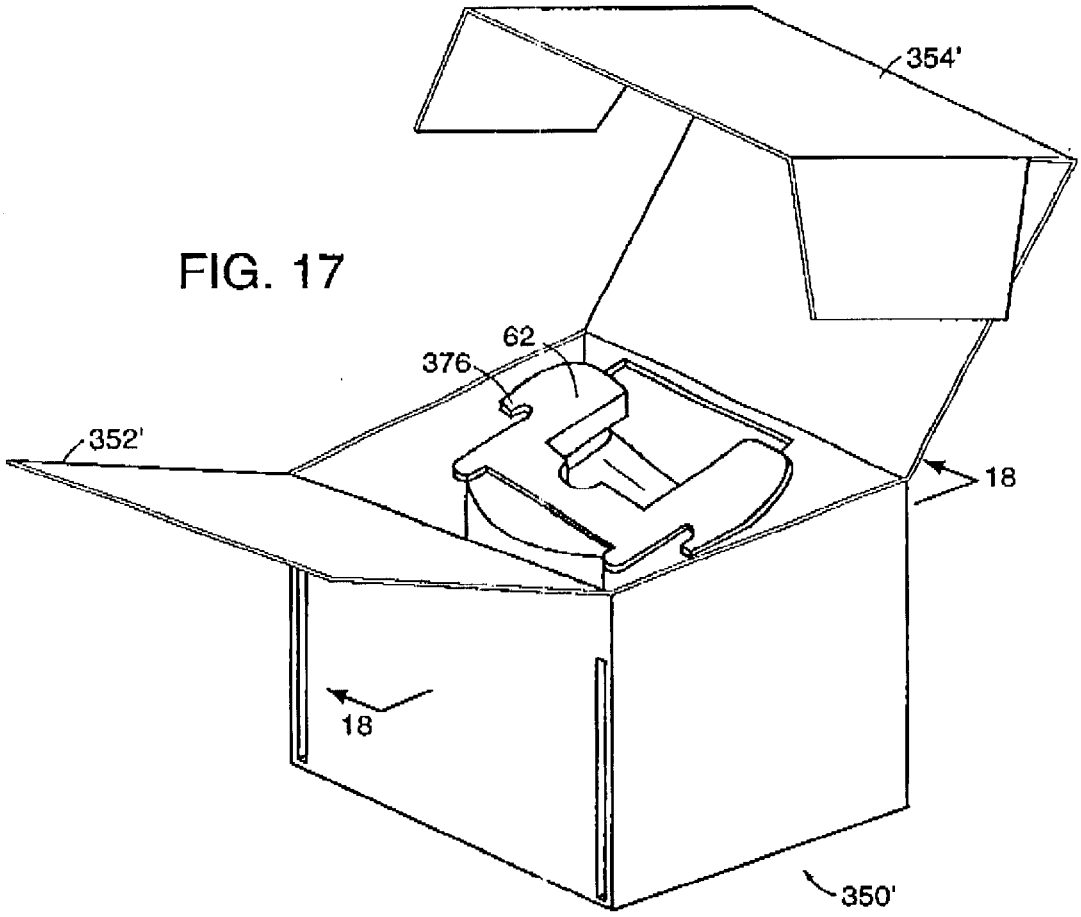
FIG. 17 is an isometric view of a container that can be used for a subassembly of that flusher conversion kit.

FIG. 17 is a view similar to FIG. 15, but the contents 376 of FIG. 17's package 350' are only a subset of the kit 348 that FIG. 15's package 350 contains. They may, for instance, exclude FIG. 2's housing 146 as well as the pressure cap 24 and the solenoid and pilot-valve members mounted on it. So the package 350' in the FIG. 17 embodiment does not include a button activator like the one that FIG. 15's box 350 includes. Instead, as FIG. 18 shows, a magnet 380 is glued to the inner surface of the package 350's bottom wall 382, and a hole 384 in an insert board 386 that rests on the bottom wall 382 receives the magnet.

Figure 18:
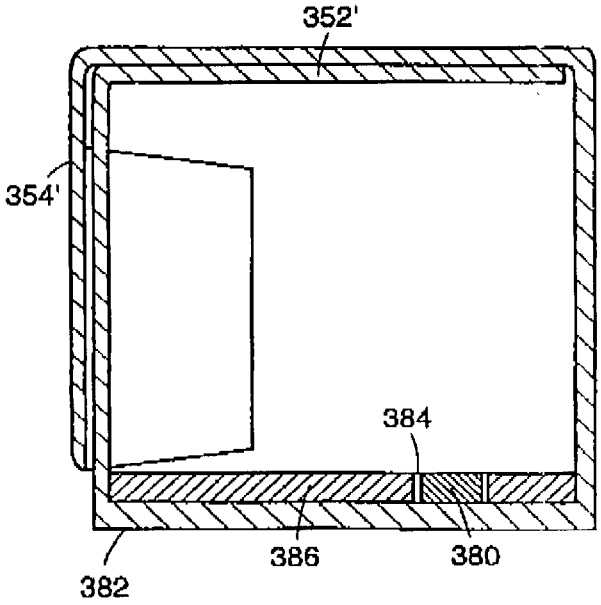
FIG. 18 is a cross section taken at line 18—18 of FIG. 17.

The circuit assembly 376, which FIG. 18 omits for the sake of simplicity, is so placed into the package that the circuit's reed switch is disposed adjacent to the magnet. That switch is therefore closed just as it is when the push button is operated, and the circuit therefore remains asleep.

What is claimed is:

1. An automatic flow controller comprising:

A) an electric valve operable by application of control signals thereto between a closed state, in which it prevents water flow therethrough, and an open state, in which it permits water flow therethrough; and B) a control circuit, including a switch operable between first and second switch states and an object sensor that generates a sensor output, for normally operating the object sensor and responding thereto by so applying control signals to the valve as to open the valve when the sensor output meets predetermined target criteria but refraining from operating the object sensor when the switch has remained in its second switch state for more than a predetermined minimum hold time.

2. An automatic flow controller as defined in claim 1 wherein the control circuit includes batteries by which it is powered.

3. An automatic flow controller as defined in claim 1 wherein the second switch state is the switch's closed state and the first switch state is the switch's open state.

4. An automatic flow controller as defined in claim 1 further including a push button that operates the switch to the second switch state when it is pressed and to the first switch state when it is released.

5. An automatic flow controller as defined in claim 1 wherein the switch is a reed switch.

6. An automatic flow controller as defined in claim 5 further including a push button that includes a magnet that so moves with the push button's operation that the magnet's magnetic field operates the reed switch to the second state when the push button is pressed and to the first state when the push button is released.

7. An automatic flow controller as defined in claim 1 wherein the control circuit responds to initial operation of the switch to its second switch state by so applying control signals to the valve as to open it.

8. An automatic flow controller as defined in claim 1 wherein the push button refrains from applying control signals to the valve when the push button has remained pressed for more than a predetermined minimum hold time.

9. An automatic flow controller as defined in claim 8 further including a push button that operates the switch to the second switch state when it is pressed and to the first switch state when it is released.

10. An automatic flow controller as defined in claim 8 wherein the control circuit includes batteries by which it is powered.

11. An automatic flow controller as defined in claim 8 wherein the control circuit responds to initial operation of the switch to its second switch state by so applying control signals to the valve as to open it.

12. An automatic flow controller as defined in claim 1 wherein the predetermined hold time is at least 30 seconds.

13. An automatic flow controller comprising:

A) an electric valve operable by application of control signals thereto between a closed state, in which it prevents water flow therethrough, and an open state, in which it permits water flow therethrough; and B) a control circuit, including a switch operable between first and second switch states and an object sensor that generates a sensor output, for normally operating the object sensor and responding thereto by so applying control signals to the valve as to open the valve when the sensor output meets predetermined target criteria but refraining from applying control signals to the valve when the switch has remained in its second switch state for more than a predetermined minimum hold time.

14. An automatic flow controller as defined in claim 13 wherein the control circuit includes batteries by which it is powered.

15. An automatic flow controller as defined in claim 13 wherein the second switch state is the switch's closed state and the first switch state is the switch's open state.

16. An automatic flow controller as defined in claim 13 further including a push button that operates the switch to the second switch state when it is pressed and to the first switch state when it is released.

17. An automatic flow controller as defined in claim 13 wherein the switch is a reed switch.

18. An automatic flow controller as defined in claim 17 further including a push button that includes a magnet that so moves with the push button's operation that the magnet's magnetic field operates the reed switch to the second state when the push button is pressed and to the first state when the push button is released.

19. An automatic flow controller as defined in claim 13 wherein the control circuit responds to initial operation of the switch to its second switch state by so applying control signals to the valve as to open it.

20. An automatic flow controller as defined in claim 13 wherein the predetermined hold time is at least 30 seconds.

21. An automatic-flow-controller kit comprising:

A) an automatic flow controller that includes:

i) an electric valve operable by application of control signals thereto between a closed state, in which it prevents water flow therethrough, and an open state, in which it permits water flow therethrough; and ii) a control circuit, including a switch and an object sensor that generates a sensor output, for normally operating the object sensor and responding thereto by so applying control signals to the valve as to open the valve when the sensor output meets predetermined target criteria but refraining from operating the object sensor when the switch has remained in its second switch state for more than a predetermined minimum hold time;

B) a push button that operates the switch to its second switch state when it is pressed and to its first switch state when it is released; and C) a container in which the automatic flow controller is disposed, the container including a button actuator that so bears against the push button when the container is closed as to keep the push button pressed.

22. An automatic-flow-controller kit as defined in claim 21 wherein the control circuit includes batteries by which it is powered.

23. An automatic-flow-controller kit as defined in claim 21 wherein the container includes a closure flap that provides the button actuator and is operable between open positions, in which it affords access to the automatic flow controller and the button actuator is spaced from the push button, and a closed position, in which the button actuator so bears against the push button as to keep it pressed.

24. An automatic-flow-controller kit as defined in claim 21 wherein the control circuit responds to initial operation of the switch to its second switch state by so applying control signals to the valve as to open it.

25. An automatic-flow-controller kit as defined in claim 21 wherein the push button refrains from applying control signals to the valve when the push button has remained pressed for more than a predetermined minimum hold time.

26. An automatic-flow-controller kit as defined in claim 25 wherein the control circuit includes batteries by which it is powered.

27. An automatic-flow-controller kit as defined in claim 25 wherein the control circuit responds to initial operation of the switch to its second switch state by so applying control signals to the valve as to open it.

28. An automatic-flow-controller kit as defined in claim 21 wherein the predetermined hold time is at least 30 seconds.

29. An automatic-flow-controller kit comprising:

A) an automatic flow controller that includes:

i) an electric valve operable by application of control signals thereto between a closed state, in which it prevents water flow therethrough, and an open state, in which it permits water flow therethrough; and ii) a control circuit, including a reed switch operable by application of a magnetic field thereto form a first switch state to a second switch state and an object sensor that generates a sensor output, for normally operating the object sensor and responding thereto by so applying control signals to the valve as to open the valve when the sensor output meets predetermined target criteria but refraining from operating the object sensor when the reed switch has remained in its second switch state for more than a predetermined minimum hold time; and B) a container that includes a magnet and in which the automatic flow controller is disposed with the reed switch so positioned with respect to the magnet as to be kept in the second switch state by the magnet's magnetic field.

30. An automatic-flow-controller kit as defined in claim 29 wherein the control circuit includes batteries by which it is powered.

31. An automatic-flow-controller kit as defined in claim 29 wherein the control circuit responds to initial operation of the switch to its second switch state by so applying control signals to the valve as to open it.

32. An automatic-flow-controller kit as defined in claim 29 wherein the push button refrains from applying control signals to the valve when the push button has remained pressed for more than a predetermined minimum hold time.

33. An automatic-flow-controller kit as defined in claim 32 wherein the control circuit includes batteries by which it is powered.

34. An automatic-flow-controller kit as defined in claim 32 wherein the control circuit responds to initial operation of the switch to its second switch state by so applying control signals to the valve as to open it.

35. An automatic-flow-controller kit as defined in claim 29 wherein the predetermined hold time is at least 30 seconds.

36. An automatic-flow-controller kit comprising:

A) an automatic flow controller that includes:

i) an electric valve operable by application of control signals thereto between a closed state, in which it prevents water flow therethrough, and an open state, in which it permits water flow therethrough; and ii) a control circuit, including a switch operable between first and second switch states and an object sensor that generates a sensor output, for normally operating the object sensor and responding thereto by so applying control signals to the valve as to open the valve when the sensor output meets predetermined target criteria but refraining from applying control signals to the valve when the switch has remained in its second switch state for more than a predetermined minimum hold time;

B) a push button that operates the switch to the second switch state when it is pressed and to the first switch state when it is released; and C) a container in which the automatic flow controller is disposed, the container including a button actuator that so bears against the push button when the container is closed as to keep the push button pressed.

37. An automatic-flow-controller kit as defined in claim 36 wherein the control circuit includes batteries by which it is powered.

38. An automatic-flow-controller kit as defined in claim 37 wherein the container includes a closure flap that provides the button actuator and is operable between open positions, in which it affords access to the automatic flow controller and the button actuator is spaced from the push button, and a closed position, in which the button actuator so bears against the push button as to keep it pressed.

39. An automatic-flow-controller kit as defined in claim 36 wherein the control circuit responds to initial operation of the switch to its second switch state by so applying control signals to the valve as to open it.

40. An automatic-flow-controller kit comprising:

A) an automatic flow controller that includes:

i) an electric valve operable by application of control signals thereto between a closed state, in which it prevents water flow therethrough, and an open state, in which it permits water flow therethrough; and ii) a control circuit, including a reed switch operable by application of a magnetic field thereto form a first switch state to a second switch state and an object sensor that generates a sensor output, for normally operating the object sensor and responding thereto by so applying control signals to the valve as to open the valve when the sensor output meets predetermined target criteria but refraining from applying control signals to the valve when the reed switch has remained in its second switch state for more than a predetermined minimum hold time; and B) a container that includes a magnet and in which the automatic flow controller is disposed with the reed switch so positioned with respect to the magnet as to be kept in the second switch state by the magnet's magnetic field.

41. An automatic-flow-controller kit as defined in claim 40 wherein the control circuit includes batteries by which it is powered.

42. An automatic-flow-controller kit as defined in claim 40 wherein the control circuit responds to initial operation of the switch to its second switch state by so applying control signals to the valve as to open it.

43. An automatic-flow-controller kit as defined in claim 40 wherein the predetermined hold time is at least 30 seconds.

44. An automatic flow controller comprising:

A) an electric flush valve operable by application of control signals thereto between a closed state, in which it prevents water flow therethrough, and an open state, in which it permits water flow therethrough; and B) a control circuit, adapted for coupling thereto of a power source by which the control circuit is thereby powered, for responding to initial coupling thereto of a power source meeting a predetermined criterion by applying a plurality of times to the flush valve control signals for operating the flush valve to its closed state.

* * * * *